US010953670B2

(12) United States Patent
Katou

(10) Patent No.: US 10,953,670 B2
(45) Date of Patent: Mar. 23, 2021

(54) PRINTING DEVICE, CONTROL METHOD, AND RECORDING MEDIUM

(71) Applicant: CASIO COMPUTER CO., LTD., Tokyo (JP)

(72) Inventor: Hajime Katou, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/283,797

(22) Filed: Feb. 24, 2019

(65) Prior Publication Data

US 2019/0291479 A1 Sep. 26, 2019

(30) Foreign Application Priority Data

Mar. 23, 2018 (JP) ..... JP2018-056870

(51) Int. Cl.
*B41J 11/66* (2006.01)
*B41J 3/407* (2006.01)

(52) U.S. Cl.
CPC ..... *B41J 11/663* (2013.01); *B41J 3/4075* (2013.01)

(58) Field of Classification Search
CPC ..... B41J 11/663
See application file for complete search history.

(56) References Cited

U.S. PATENT DOCUMENTS 6,126,343 A 10/2000 Sugiyama et al.
6,676,314 B2 * 1/2004 Tanaka ..... B41J 3/4075 400/61
9,487,035 B2 11/2016 Wakayama
2016/0217353 A1 * 7/2016 Nagashima ..... G06K 15/16
2018/0015742 A1 * 1/2018 Inoue ..... B41J 11/666

FOREIGN PATENT DOCUMENTS

| | | | |
|---|---|---|---|
| CN | 1432474 | A | 7/2003 |
| JP | H07251983 | A | 10/1995 |
| JP | 2003063071 | A | 3/2003 |
| JP | 2009229539 | A | 10/2009 |
| JP | 2010195021 | A | 9/2010 |
| JP | 2014028448 | A | 2/2014 |
| JP | 2016137627 | A | 8/2016 |

OTHER PUBLICATIONS

Chinese Office Action (and English language translation thereof) dated Apr. 29, 2020 issued in Chinese Application No. 201910196605.5.

Japanese Office Action (and English language translation thereof) dated Jan. 21, 2020 issued in Japanese Application No. 2018-056870.

* cited by examiner

*Primary Examiner* — Shelby L Fidler
(74) *Attorney, Agent, or Firm* — Holtz, Holtz & Volek PC

(57) ABSTRACT

When the length of a label created by cutting a print medium with print data printed thereon is insufficient, a printing device is prevented from omitting cutting processing. A printing device 1 includes a printing unit 106 which prints out print data on a tape 42 as a print medium, a cutting unit 107 which cuts the tape 42 with the print data printed thereon, a determination unit 108 which determines whether the length of a label to be cut by the cutting unit 107 is e more than a threshold value, and a control unit 101 which, when the determination unit 108 determines that the length is less than or equal to the threshold value, adjusts the length of the label so that the length of the tape 42 will be a length more than the threshold value.

10 Claims, 8 Drawing Sheets

PRINTING DEVICE, CONTROL METHOD, AND RECORDING MEDIUM

CROSS-REFERENCE TO RELATED APPLICATION

This application is based upon and claims the benefit of priority from the prior Japanese Patent Application No. 2018-056870, filed Mar. 23, 2018, the entire contents of which are incorporated herein by reference.

BACKGROUND OF THE INVENTION

1. Field of the Invention

This technical field relates to a printing device, a control method, and a recording medium.

2. Description of the Related Art

Conventionally, there is known a label printer for printing out characters, figures, and the like on a print tape wound in the longitudinal direction to have a roll shape to create a label. As this type of label printer, there is a label printer on which a tape cartridge storing a print medium including a tape in a box-shaped member is loaded to print out characters, figures, and the like on the tape supplied from the tape cartridge.

There is also a label printer which can perform a full cut and a half cut when cutting out an area in which characters, figures, and the like are printed on the tape supplied from the tape cartridge. The half cut is a method of cutting in such a manner that plural areas to be separated from one another when used as labels are integrally held. For example, when the tape supplied from the tape cartridge is a tape including an adhesive tape on which characters and the like are printed, and a separator for protecting the adhesive face of the adhesive tape, the entire tape (the adhesive tape and the separator) is cut in terms of full cut, and only the adhesive tape is cut in terms of half cut. The half cut is applied to cutting a boundary between areas used as labels, and cutting a boundary between a margin area (unprintable area) produced during printing and an area used as a label.

Japanese Patent Application Laid-Open No. 2014-028448 discloses a label printer in which a tape cartridge storing a print medium is housed. Further, Japanese Patent Application Laid-Open No. 2010-195021 discloses a tape printer which half cuts a boundary between a margin area and an area used as a label.

In the above-mentioned label printer (tape printing device), the length of a printing area in which characters, figures, and the like are printed on a tape may be less than or equal to a length from the position of a cutter for a full cut to a label outlet on a feeding path. In this case, a label obtained by full cutting the printing area may be retained on the feeding path without being ejected from the label outlet. Therefore, many label printers omit the full cut to eject the tape (printing area) when the length of the label obtained by full cutting the printing area is less than or equal to the length from the position of the cutter for the full cut to the label outlet. However, in this type of label printer, since a user cuts the tape with scissors or the like, the working efficiency is reduced. Further, when the length of the tape (printing area) is short, since a half cut may cause trouble such as a tape jam, the half cut may not be made when the length of the tape is less than or equal to a threshold value (e.g., 2 cm).

The present invention has been made in view of the above circumstances, and it is an object thereof to provide a technique capable of preventing a printing device from omitting cutting processing when the length of a label created by cutting a tape with print data printed thereon is insufficient.

SUMMARY OF THE INVENTION

According to one aspect of the present invention, there is provided a printing device including: a printing unit which prints out print data on a print medium; a cutting unit which cuts the print medium with the print data printed thereon; and a processor, wherein the processor determines whether the length of a label to be created by the cutting unit cutting the print medium is more than a threshold value, and when determining that the length is less than or equal to the threshold value, the processor adjusts the length of the label so that the length of the print medium will be a length more than the threshold value.

According to another aspect of the present invention, there is provided a control method executed by a printing device including a processor, the control method including the steps of: determining whether the length of a label to be created by cutting a print medium with print data printed thereon is more than a threshold value; and when determining that the length is less than or equal to the threshold value, adjusting the length of the label so that the length of the label will be a length more than the threshold value.

According to still another aspect of the present invention, there is provided a non-transitory recording medium recording thereon a computer-readable program executed by a printing device including a processor, the program causing the processor to execute the processes of: determining whether the length of a label to be created by cutting a print medium with print data printed thereon is more than a threshold value; and when determining that the length is less than or equal to the threshold value, adjusting the length of the label so that the length of the label will be a length more than the threshold value.

BRIEF DESCRIPTION OF THE SEVERAL VIEWS OF THE DRAWING

For a better understanding of this application, reference is made to the following detailed description considered in conjunction with the accompanying drawings.

DETAILED DESCRIPTION OF THE INVENTION

Figure 1:
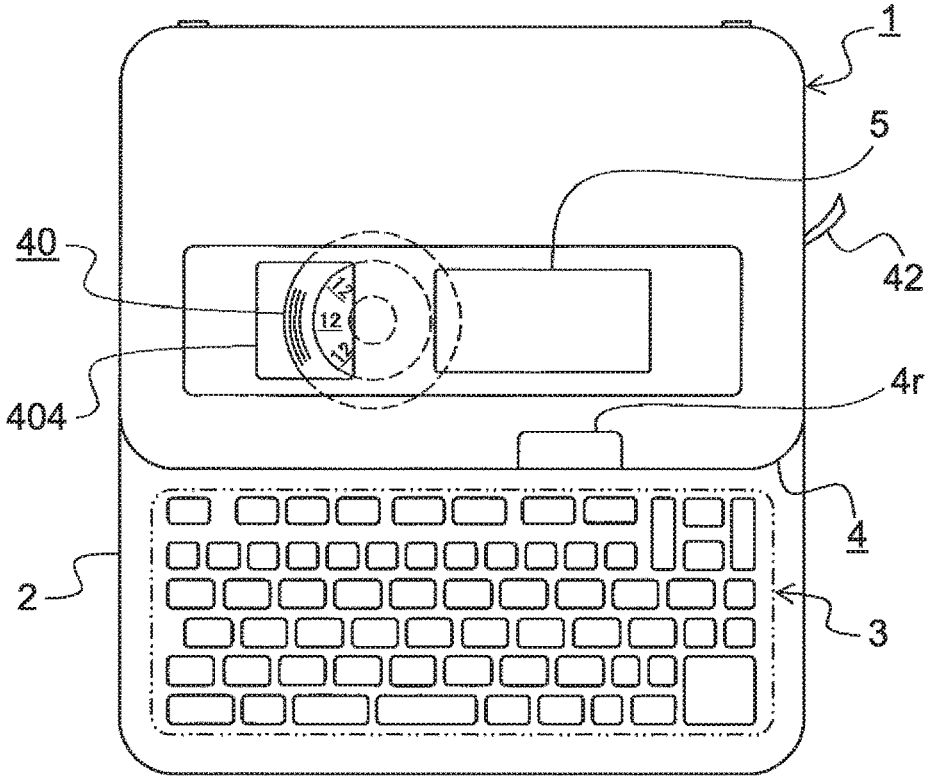
FIG. 1 is a plan view of a printing device 1 in a state where a cover 4 is closed.
Figure 2:
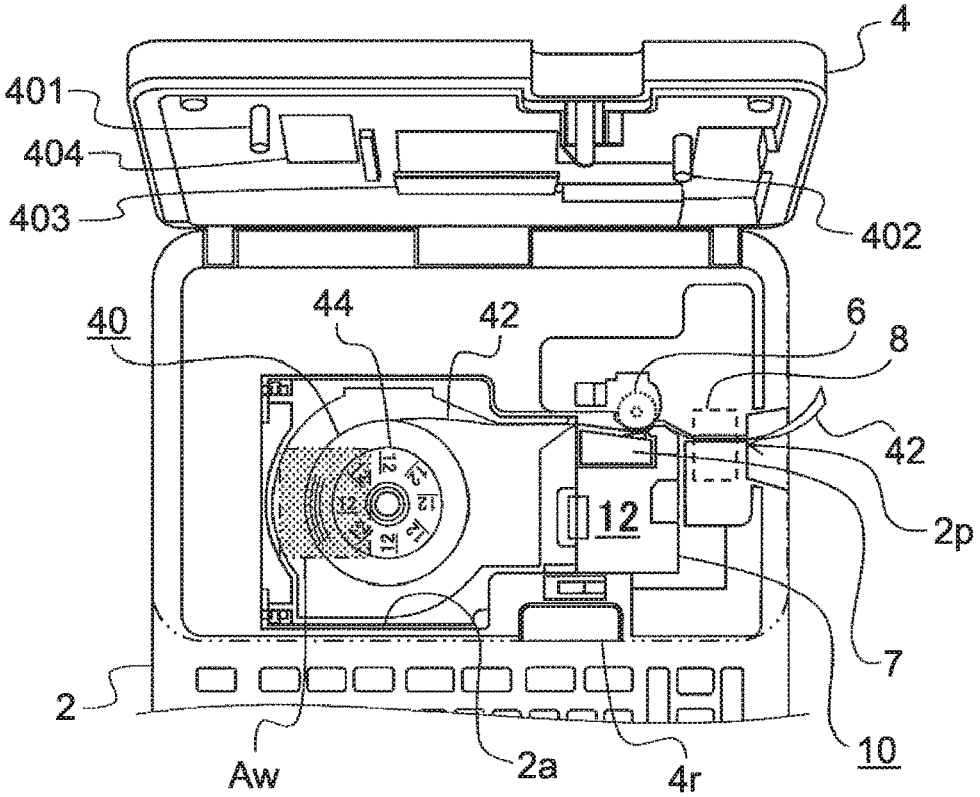
FIG. 2 is a plan view of the printing device 1 in a state where the cover 4 is open.

The structure of a printing device according to one embodiment will first be described with reference to FIG. 1 and FIG. 2. FIG. 1 is a plan view of a printing device 1 in a state where a cover 4 is closed. FIG. 2 is a plan view of the printing device 1 in a state where the cover 4 is open.

The printing device 1 illustrated in FIG. 1 and FIG. 2 is a label printer which performs printing on a thermal tape 42 as a print medium contained in a recording medium 40. The thermal tape 42 is an example of a print tape. In this specification, a thermal label printer which performs printing on the thermal tape 42 is described below as an example of the printing device 1, but the printing method for the printing device 1 is not particularly limited. For example, the printing device 1 may be a thermal-transfer label printer using an ink ribbon. Further, the printing device 1 as the label printer is not limited to the thermal printer mentioned above. For example, the printing device 1 may be an ink-jet printer, a laser printer, or the like. Further, the printing device 1 may perform printing in the form of single-path (one-path) routing or multipath routing (scanning).

The printing device 1 includes a device housing 2, an input device 3, the cover 4, a display device 5, a platen roller 6, a thermal head 7, and a cutter 8. Further, though not illustrated, the printing device 1 includes various electronic components, such as a printed circuit board, a power supply unit, various terminals, and various wiring cables.

The device housing 2 is a box-shaped member in which the printed circuit board (not illustrated) including part of a control circuit for controlling the operation of the printing device 1, the input device 3, the platen roller 6, the thermal head 7, the cutter 8, and the like are arranged. The cover 4 is attached to the device housing 2 openably and closably. Further, though not illustrated, a power cord connection terminal, an external device connection terminal, a storage media insertion slot, and the like are provided in the device housing 2.

In an area of the device housing 2, which is below the cover 4 when the cover 4 is closed, an adapter storage part 2*a*, the platen roller 6, the thermal head 7, and the cutter 8 are arranged. The adapter storage part 2*a* is a recessed storage space capable of storing a medium adapter 10. The medium adapter 10 is a case member for storing the recording medium 40 including the thermal tape 42. The thermal tape 42 on which characters and the like are printed by the printing device 1 is supplied from the medium adapter 10.

The platen roller 6 is a roller which feeds the thermal tape 42 supplied from the medium adapter 10. The platen roller 6 rotates by the rotation of a feeding motor, not illustrated. The feeding motor is, for example, a stepping motor, a direct-current (DC) motor, or the like. In the printing device 1, the platen roller 6 is rotated in such a state that the thermal tape 42, sent out from the medium adapter 10, is sandwiched between the platen roller 6 and the thermal head 7 to feed the thermal tape 42 in the feeding direction. The platen roller 6 and the feeding motor (not illustrated) are an example of a feeding unit to feed a print tape.

The thermal head 7 is a print head which performs printing on the thermal tape 42. The thermal head 7 has multiple heating elements arrayed in a main scanning direction perpendicular to the feeding direction of the thermal tape 42 to heat the thermal tape 42 using the heating elements so as to perform printing one line by one line. The thermal head 7 is an example of a printing unit to print out print data on the print tape.

The cutter 8 cuts the thermal tape 42. The cutter 8 makes a full cut or a half cut at a predetermined position in the longitudinal direction (feeding direction) of the thermal tape 42. As will be described later, the thermal tape 42 exemplified in the embodiment is such that an adhesive layer in a printing adhesive tape (label layer 426) used as a label is protected by a separator (release paper). The full cut when the thermal tape 42 including such a separator is cut is a cutting method for cutting the entire thermal tape 42 including the separator (release paper). The half cut when the thermal tape 42 including the separator is cut is a cutting method for not cutting the separator in the thermal tape 42. The cutter 8 is an example of a cutting unit for cutting a tape with print data printed thereon.

The input device 3 is provided on the upper face of the device housing 2 in an area not being overlapped with the cover 4 in the state where the cover 4 is closed. The input device 3 is an example of an input device used by a user to enter print data such as characters, figures, and the like to be printed on the thermal tape 42, and to enter various instructions in order to control the operation of the printing device 1. The input device 3 includes various keys such as input keys, a cross key, a conversion key, and an enter key. The input keys are keys used to enter characters and various instructions. The cross key is a key used to move a cursor. The conversion key is a key used to perform a Kana-to-Kanji conversion of an entered character string. The enter key is a key used to confirm conversion processing, various setting processing, and the contents of various processing.

The cover 4 is arranged on the device housing 2 to make the adapter storage part 2*a* openable and closable. The cover 4 is kept closed as illustrated in FIG. 1 by an unillustrated lock mechanism. The user can press down a button 4*r* provided on the device housing 2 to release the lock mechanism in order to open the cover 4 as illustrated in FIG. 2. Further, as illustrated in FIG. 2, the medium adapter 10 loaded onto the printing device 1 according to the embodiment is such that a face opposite to the cover 4 when the medium adapter 10 is stored in the adapter storage part 2*a* and the cover 4 is closed is formed by a transparent member. In other words, the user can visually confirm whether the recording medium 40 is stored in the medium adapter 10 in such a state that the medium adapter 10 is stored in the adapter storage part 2*a*. Further, the cover 4 in the printing device 1 according to the embodiment is such that a window 404 is provided in a position overlapped with a partial area Aw of the recording medium 40 stored in the medium adapter 10 when the cover 4 is closed. Therefore, the user can visually confirm whether the medium adapter 10 (print medium 40) is housed in the printing device 1 even in the closed state of the cover 4. Further, when the print medium 40 stored in the medium adapter 10 includes an attention sheet 44 indicative of the width and color of the thermal tape 42, the user can check on the width and color of the thermal tape 42 through the window 404 of the cover 4.

The printing device 1 prints out print data, created by the user operating the input device 3, on the thermal tape 42 supplied from the medium adapter 10. The print data include information on the layout, size, and margin areas of characters and figures to be printed on the thermal tape 42. Further, the printing device 1 uses the cutter 8 to cut an area where the print data are printed on the thermal tape 42. The cut area (the area where the print data are printed) is ejected as a label from an outlet 2*p* provided in the device housing 2. These operations performed by the printing device 1 are controlled by a computer incorporated in the printing device 1.

Further, the printing device 1 can perform printing on plural types of thermal tapes 42 different in width, respectively. Therefore, the adapter storage part 2*a* of the device housing 2 in the printing device 1 of the embodiment is formed into a recessed shape capable of storing plural types of medium adapters 10 different in width of the print mediums 40 (thermal tapes 42) to be stored, respectively. These plural types of medium adapters 10 have the same planar shape as illustrated in FIG. 2, but different in dimension of the thickness direction corresponding to the width direction of the thermal tapes 42.

When the medium adapter 10 is stored in the adapter storage part 2*a* to perform printing, the medium adapter 10 is kept in a state capable of suppressing a positional deviation in the thickness direction in order to prevent a positional deviation in the width direction of the thermal tape 42 supplied to the thermal head 7. Therefore, in the printing device 1 on which plural types of medium adapters 10 different in dimension in the thickness direction are available, fin portions (not illustrated) provided on an outer peripheral side face of an adapter body are sandwiched between supporting portions (not illustrated) provided in the adapter storage part 2*a* and supporting portions 401, 402 provided under the cover 4 to hold the medium adapter 10. Further, in the printing device 1 of the embodiment, an adapter pressing portion 403 is provided under the cover 4 to prevent the looseness of the medium adapter 10 caused during printing or the like due to a shape tolerance between the supporting portions of the adapter storage part 2*a* and the supporting portions 401, 402 of the cover 4. When the cover 4 is closed in the state of storing the medium adapter 10 in the adapter storage part 2*a*, the adapter pressing portion 403 applies pressing load to the medium adapter 10 by an elastic restoring force of an elastic member such as a spring.

The display device 5 is arranged on a face of the cover 4 among faces facing outward when the cover 4 is closed. The display device 5 is, for example, a liquid crystal display, an organic EL (electro-luminescence) display, or the like. The display device 5 displays characters and figures corresponding to input from the input device 3, selection menus for various settings, messages related to various processing, and the like. Note that the display device 5 may have a function as part of the input device 3 such as a display with a touch panel thereon.

In the printing device 1 of the embodiment, the medium adapter 10 is stored in the adapter storage part 2*a* of the device housing 2 as mentioned above. The medium adapter 10 is a case for storing the print medium 40 including the thermal tape 42. The print medium 40 is so stored that the user can replace the print medium 40 appropriately. In other words, the medium adapter 10 according to the embodiment is designed on the assumption that the user takes the print medium 40 in and out of the medium adapter 10.

Further, as mentioned above, the printing device 1 of the embodiment can perform printing on plural types of thermal tapes 42 different in tape width, respectively. Therefore, the medium adapter 10 used in combination of the printing device 1 of the embodiment is prepared for each printable tape width. For example, in the printing device 1 of the embodiment, printing can be performed on a thermal tape with a tape width of 6 mm, a thermal tape with a tape width of 9 mm, a thermal tape with a tape width of 12 mm, and a thermal tape with a tape width of 18 mm, respectively. In this case, as the medium adapters 10 used in combination with the printing device 1, a medium adapter storing the thermal tape with the tape width of 6 mm, a medium adapter storing the thermal tape with the tape width of 9 mm, a medium adapter storing the thermal tape with the tape width of 12 mm, and a medium adapter storing the thermal tape with the tape width of 18 mm are prepared. These plural types of medium adapters have the same planar shape as illustrated in FIG. 2, but different in dimension of the thickness direction corresponding to the tape width direction of the recording media 40 (thermal tapes 42) to be stored. Further, information indicative of the tape width of the recording medium 40 (thermal tape 42) to be stored is printed on a face of each of the plural types of medium adapters 10 different in dimension in the thickness direction, which is the top face when the medium adapter is stored in the adapter storage part 2*a*. For example, a number "12" is printed on the medium adapter 10 in FIG. 2. In other words, the medium adapter 10 in FIG. 2 is formed with a dimension suitable for storing the thermal tape 42 (recording medium 40) with the tape width of 12 mm. When a thermal tape (recording medium 40) with a tape width narrower than the tape width of 12 mm is stored in the medium adapter 10 in FIG. 2, the positional variation of the recording medium 40 in the tape width direction becomes large, and hence the position of the thermal tape 42 supplied from the medium adapter 10 becomes unstable in the width direction. On the other hand, when a thermal tape (recording medium 40) with a tape width wider than the tape width of 12 mm is stored in the medium adapter 10 in FIG. 2, the cover cannot be closed, for example.

Figure 3:
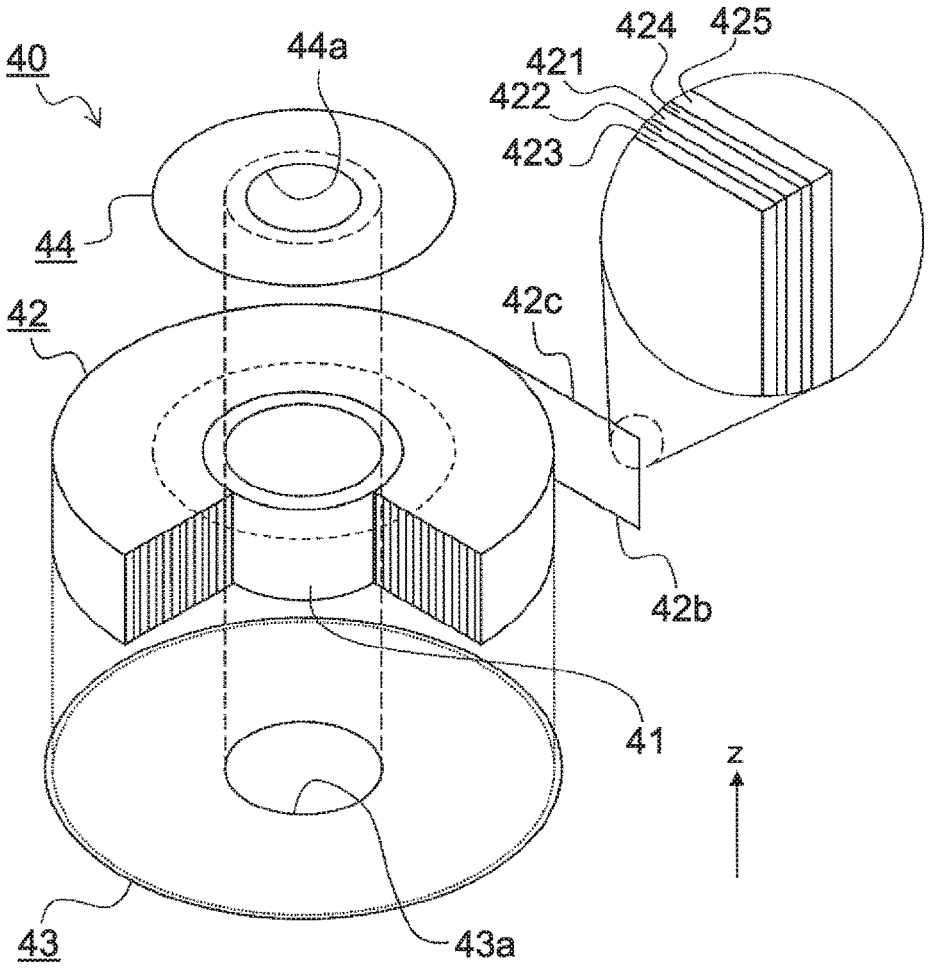
FIG. 3 is an exploded perspective view for describing the structure of a recording medium 40.

FIG. 3 is an exploded perspective view for describing the structure of the recording medium 40. As illustrated in FIG. 3, the recording medium 40 stored in the medium adapter 10 includes a tubular member 41, the thermal tape 42, a loosening prevention sheet 43, and the attention sheet 44.

The tubular member 41 is a member which becomes the axis of rotation (supporting point of rotation) of the recording medium 40 when the recording medium 40 is stored in the medium adapter 10. For example, a paper tube or the like can be used for the tubular member 41. Note that the shape of the tubular member 41 is not limited to the cylindrical shape as illustrated in FIG. 3, and it may be any shape as long as the tubular member 41 is engaged with a supporting portion provided in the medium adapter 10 to be rotatable around an axial direction as the axis of rotation. When the supporting portion provided in the medium adapter 10 has a cylindrical shape, the tubular member 41 may have, for example, a tubular shape with its opening face formed into a regular polygon (e.g., a regular octagon, or the like).

As mentioned above, the thermal tape 42 is a print tape on which characters, figures, and the like are printed. The recording medium 40 to be stored in the medium adapter 10 is provided to the user in such a state that the thermal tape 42, the longitudinal dimension of which is a predetermined length (for example, about 5 m to 10 m), is wound around the circumferential side face of the tubular member 41. In other words, the thermal tape 42 in the recording medium 40 is wound in the longitudinal direction to have a ring shape, and supplied to the printing device 1 and consumed sequentially from the circumferential side of the ring shape. In the following description, the thermal tape 42 wound in the longitudinal direction to have the ring shape is also called the "ring-shaped thermal tape 42."

For example, the thermal tape 42 is such that a separator 425, an adhesive layer 424, a base material 421, a coloring layer 422, and a protective layer 423 are laminated in this order.

The base material 421 is a tape-shaped member as a base in the thermal tape 42, which is formed, for example, of PET (polyethylene terephthalate). Plural colors as the colors of base materials 421 can be prepared to provide plural types of thermal tapes 42 different in tape color. For example, five colors of white, red, blue, yellow, and transparent color can be used as the base materials 421 to provide thermal tapes 42 of five colors.

On one of end faces (main surfaces) of the base material 421 in the thickness direction, the coloring layer 422 heated at a predetermined temperature or higher to develop color (change in color) and the protective layer 423 that protects the coloring layer 422 are laminated. Further, on the other end face of the base material 421 in the thickness direction, the adhesive layer 424 and the separator 425 are laminated. The adhesive layer 424 is provided, for example, by applying an adhesive material to the base material 421, and used to apply, to a desired object, a piece of tape (label) including the base material 421, the coloring layer 422, and the protective layer 423 after being printed. The separator 425 is a member for protecting the adhesive layer 244 before the piece of tape (label) is applied to the desired object, which is stuck peelably to the adhesive layer 424. In other words, the adhesive layer 424, the base material 421, the coloring layer 422, and the protective layer 423 compose the adhesive tape (label layer) used as a label in the thermal tape 42 of FIG. 3.

As illustrated in FIG. 3, the thermal tape 42 having the five-layer structure mentioned above is wound around the tubular member 41 with the protective layer 423 on the inner diameter side and the separator 425 on the outer diameter side.

Note that the thermal tape 42 is not limited to the structure mentioned above. For example, the thermal tape 42 may be such that the adhesive layer 424 is exposed without including the separator 425. Further, the thermal tape 42 may be such that the coloring layer 422 is exposed without including the protective layer 423. In addition, for example, the coloring layer 422 in the thermal tape 42 may be a layer which changes from a colored state to a colorless and transparent state when heated.

A loosening prevention sheet 43 is an adhesive sheet stuck on one of the side faces of the ring-shaped thermal tape 42 to keep the thermal tape 42 in the ring shape. Here, the side faces of the ring-shaped thermal tape 42 means end faces in the axial direction of the ring-shaped thermal tape 42 (tubular member 41), that is, a surface formed by one edge 42*b* and a surface formed by the other edge 42*c* in the width direction of the thermal tape 42. In the recording medium 40 of FIG. 3, the loosening prevention sheet 43 is stuck on the side face formed by the edge 42*b* of the thermal tape 42 out of the side faces of the ring-shaped thermal tape 42.

A ring-shaped adhesive sheet having an opening 43*a* in the central part is used as the loosening prevention sheet 43. The size of the opening 43*a* of the loosening prevention sheet 43 is the same as the size (inner diameter) of a hollow part of the tubular member 41 around which the thermal tape 42 is wound, or larger than the size of the hollow part of the tubular member 41. The loosening prevention sheet 43 is stuck on the thermal tape 42 in such a manner that the entire outline of the hollow part of the tubular member 41 is contained in the opening 43*a* of the loosening prevention sheet 43.

Although the thermal tape 42 having the multi-layer structure as mentioned above can expand and contract by changes in temperature, humidity, and the like, the expansion rate varies from layer to layer (from material to material). Therefore, when the thermal tape 42 is wound simply around the tubular member 41 (that is, when the loosening prevention sheet 43 is not stuck), the shape of the thermal tape 42 can change by the expansion and contraction of the thermal tape 42 to loosen the thermal tape 42. Further, when the thermal tape 42 including the separator 425 as mentioned above is wound around the tubular member 41, the separator 425 and the protective layer 423 adjacent to each other in the radial direction of a roll of tape are in a contact state. Therefore, when the thermal tape 42 is wound simply around the tubular member 41 (when the loosening prevention sheet 43 is not stuck), the shape of the thermal tape 42 can change, for example, by the application of an external force due to a fall of the recording medium 40 or the like to loosen the thermal tape 42.

When the loosening prevention sheet 43 is stuck on the one side face of the ring-shaped thermal tape 42 (the surface formed by the edge 42*b* of the thermal tape 42), positional relations of different areas adjacent to one another in the radial direction of the thermal tape 42 can be maintained by the loosening prevention sheet 43. Thus, stacking of the loosening prevention sheet 43 can lead to suppressing shape changes due to the expansion and contraction of the ring-shaped thermal tape 42, shape changes by the application of an external force, and the like, and hence preventing the thermal tape 42 from being loosened.

Further, it is desired that the loosening prevention sheet 43 should have a size enough to cover the entire side face of the ring-shaped thermal tape 42 as illustrated in FIG. 3 when the recording medium 40 is in an unused state. In other words, it is desired that the diameter of the loosening prevention sheet 43 should be larger than the diameter (maximum diameter) of the ring-shaped thermal tape 42. In this case, since the whole of one side face of the ring-shaped thermal tape 42 can be held on the adhesive face, the ring shape can be maintained more reliably.

Further, it is desired that the shape of the loosening prevention sheet 43 should be a shape approximated to the shape of the side face of the ring-shaped thermal tape 42. In other words, when the side face of the ring-shaped thermal tape 42 has an annular shape, it is desired that the loosening prevention sheet 43 should also have an annular shape. This can reduce areas of the loosening prevention sheet 43, which do not contribute to maintaining the shape of the thermal tape 42, and hence reduce the size of the loosening prevention sheet 4. Since the exposed area of the adhesive face of the loosening prevention sheet 43 is also reduced, the adhesion of dust, dirt, and the like to the loosening prevention sheet 43 can also be suppressed.

The attention sheet 44 is an adhesive sheet applied to the other side face of the ring-shaped thermal tape 42 (that is, the side face formed by the edge 42*c* of the thermal tape 42 in the width direction) to present, to the user, information indicative of the type of thermal tape 42. Though not illustrated in FIG. 3, the information indicative of the type of thermal tape 42 is printed on a surface of the attention sheet 44, which is opposite to a surface to face the thermal tape 42. As the information indicative of the type of thermal tape 42, for example, the width of the thermal tape 42, the model number of the recording medium 40, and the like are printed on the attention sheet 44. Further, the color of the thermal tape 42 is represented, for example, by the background color of the attention sheet 44. There are various types of thermal tapes 42, depending on differences in the tape width, the color of a surface (base material 421) to be printed, and the like. Therefore, the attention sheet 44 on which the information for designating the type of thermal tape 42 is printed is applied to the side face of the thermal tape 42 to allow the user to identify the type of print medium 40 easily (see FIG. 2).

A ring-shaped adhesive sheet having an opening 44*a* in the central part is used as the attention sheet 44. The size of the opening 44*a* of the attention sheet 44 is set smaller than the size (inner diameter) of the hollow part of the tubular member 41 around which the thermal tape 42 is wound. The attention sheet 44 is applied to the side face of the ring-shaped thermal tape 42 in such a manner that the center of the opening 44*a* is substantially concentric with the center (axial center) of the hollow part of the tubular member 41. It is also desired that the attention sheet 44 should be smaller than the side face of the ring-shaped thermal tape 42 at least before the start of use of the print medium 40, such as at the time of sale of the print medium 40. This can reduce an area of the side face (the surface formed by the edge 42*c*) of the thermal tape 42, which is covered with the attention sheet 44, and hence allow the user to check on the remaining amount of the thermal tape 42 easily.

As mentioned above, the recording medium 40 in FIG. 3 is stored in the medium adapter 10 to be rotatable around the axial direction of the tubular member 41 as the axis of rotation. The thermal tape 42 of the recording medium 40 stored in the medium adapter 10 is sent out to the outside of the medium adapter 10 from a tape exit slot provided in the medium adapter 10. The printing device 1 performs printing processing for printing out print data such as characters, figures, and the like on the thermal tape 42 sent out to the outside of the medium adapter 10 (i.e., the thermal tape 42 supplied from the medium adapter 10), and cutting processing for cutting the thermal tape 42 with the print data printed thereon.

Figure 4:
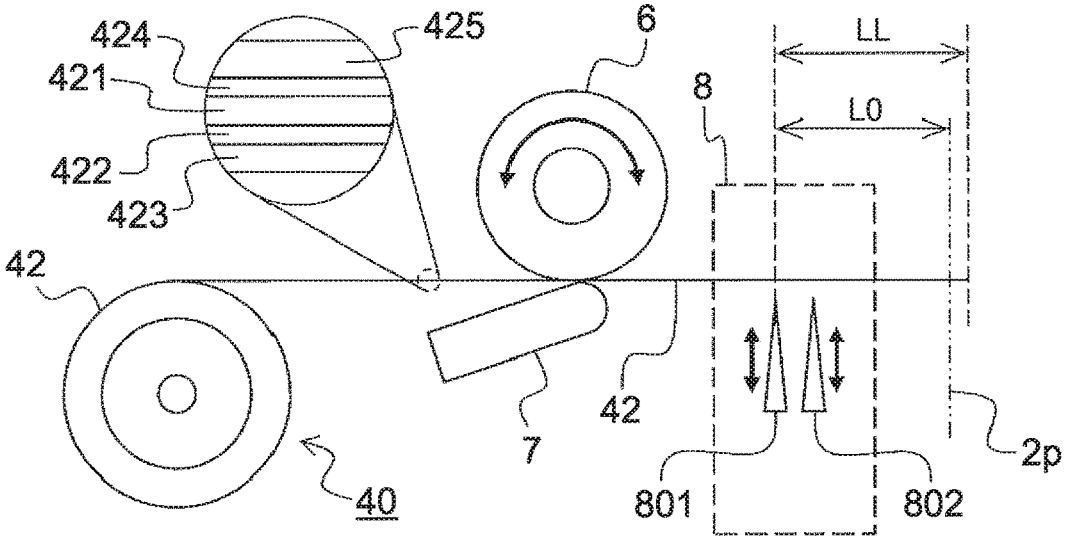
FIG. 4 is a diagram for describing an overview of printing processing and cutting processing performed by the printing device 1.

FIG. 4 is a diagram for describing an overview of the printing processing and the cutting processing performed by the printing device 1. As illustrated in FIG. 4, the thermal tape 42 sent out to the outside of the medium adapter 10 is sandwiched between the platen roller 6 and the thermal head 7 and fed by the rotation of the platen roller 6.

At the time of printing on the thermal tape 42, the printing device 1 feeds the thermal tape 42 in a direction toward an outlet 2*p* of the printing device 1 while rotating the platen roller 6 at a predetermined rotational speed in a predetermined rotational direction (e.g., in a counterclockwise direction in FIG. 4). At this time, the printing device 1 applies heat energy to the thermal tape 42 passing through the thermal head 7 (heating elements) based on the print data (the content to be printed) to perform printing on the thermal tape 42.

Further, at the time of cutting the thermal tape 42, the printing device 1 rotates the platen roller 6 at a predetermined rotational speed in a predetermined rotational direction to feed the thermal tape 42 so that the cutting position of the thermal tape 42 in the longitudinal direction will come to a position corresponding to a first blade 801 or a second blade 802 of the cutter 8. In the case of a full cut, the printing device 1 feeds the thermal tape 42 so that a position (full-cut position) of the thermal tape 42 at which the full cut is made will come to a position corresponding to the first blade 801 on the feeding path of the thermal tape 42. In the case of a half cut, the printing device 1 feeds the thermal tape 42 so that a position (half-cut position) of the thermal tape 42 at which the half cut is made will come to a position corresponding to the second blade 802 on the feeding path of the thermal tape 42.

Figure 5:
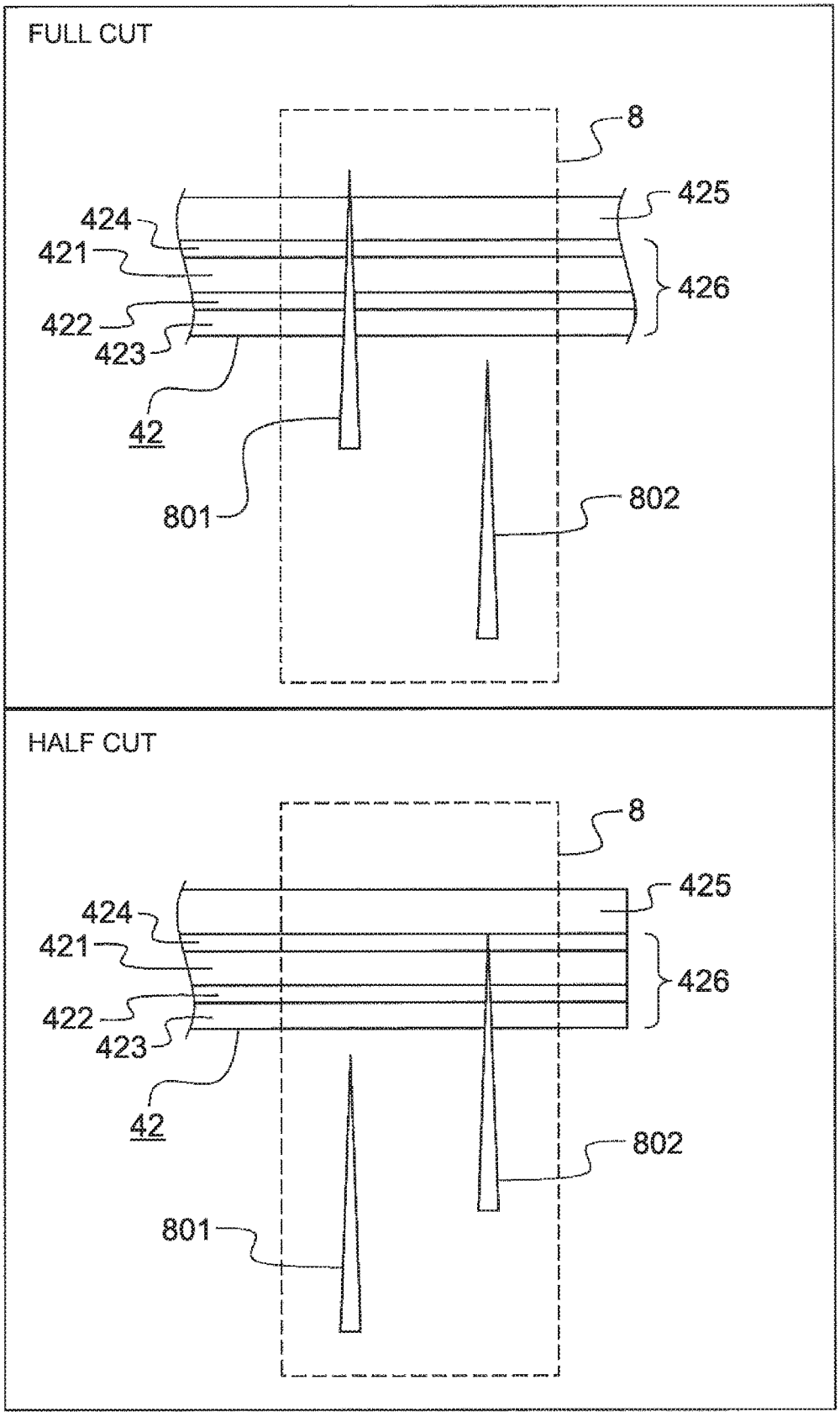
FIG. 5 is a diagram for describing a full cut and a half cut performed by the printing device 1.

FIG. 5 is a diagram for describing a full cut and a half cut performed by the printing device 1.

In the embodiment, the five-layered thermal tape 42 including the separator 425 is exemplified as the print tape. The cutter 8 in the printing device 1 of the embodiment is, for example, such that the first blade 801 and the second blade 802 are arranged in a direction opposite to the protective layer 423 in the thermal tape 42 as illustrated in FIG. 4 and FIG. 5. Further, though not illustrated in FIG. 4 and FIG. 5, the cutter 8 has blade rests respectively corresponding to the first blade 801 and the second blade 802, which are arranged on the other side of the thermal tape 42 as a border in a direction opposite to the direction in which the first blade 801 and the second blade 802 are arranged.

When a full cut of the thermal tape 42 is made, the printing device 1 moves the first blade 801 toward the side of the thermal tape 42 as illustrated in FIG. 5 to cut all the five layers included in the thermal tape 42. In other words, when the full cut of the thermal tape 42 is made, a label layer (printing adhesive tape) 426, in which the adhesive layer 424, the base material 421, the coloring layer 422, and the protective layer 423 are laminated in this order, and the separator 425 for protecting the adhesive layer 424 in the label layer 426 are cut.

On the other hand, when a half cut of the thermal tape 42 is made, the printing device 1 moves the second blade 802 toward the side of the thermal tape 42 as illustrated in FIG. 5 to cut four layers except the separator 425 in the five layers included in the thermal tape 42. In other words, when the half cut of the thermal tape 42 is made, the printing device 1 cuts only the label layer (printing adhesive tape) 426 in which the adhesive layer 424, the base material 421, the coloring layer 422, and the protective layer 423 are laminated in this order. In this case, two label layers 426 cut as a result of making the half cut are integrally held by the separator 425. In other words, when the half cut is made, the printing device 1 makes a cut in the thermal tape 42 in such a manner that two areas adjacent to each other across a half-cut position of the thermal tape 42 as a border are integrally held.

In the printing device 1 of the embodiment, the thermal tape 42 is fed by the platen roller 6 alone. Therefore, for example, a label cannot be ejected from an outlet 2*p* unless a length LL of a label with print data printed on the thermal tape 42 is set longer than a distance L0 from the first blade 801 to the outlet 2*p* in the printing device 1 as illustrated in FIG. 4. Further, when the length LL of the printed label is less than a length enough to make a half cut, the half cut cannot be made. However, the length of a printing area in which print data is printed may be less than or equal to the distance L0 depending on the content printed on the thermal tape 42. Therefore, in the printing device 1 of the embodiment, a length from the tip of the thermal tape 42 to the edge of the printing area (printing start position) in which the print data are printed, i.e., the length of a margin area is so adjusted that the length of the label with the print data printed on the thermal tape 42 will be a length enough to make a half cut and longer than the distance L0 from the first blade 801 to the outlet 2*p*.

Figure 6:
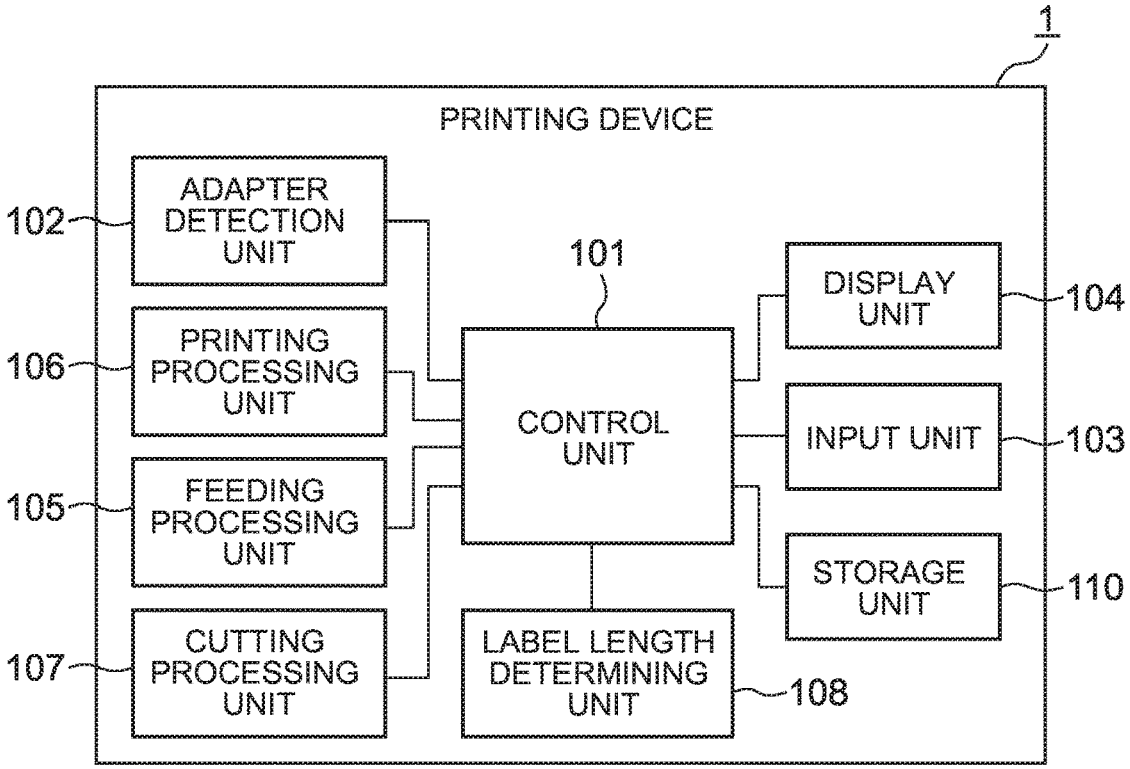
FIG. 6 is a block diagram illustrating a functional configuration of the printing device 1 according to one embodiment.

FIG. 6 is a block diagram illustrating a functional configuration of the printing device 1 according to one embodiment. As illustrated in FIG. 6, the printing device 1 of the embodiment includes, in terms of a functional configuration, a control unit 101, an adapter detection unit 102, an input unit 103, a display unit 104, a feeding processing unit 105, a printing processing unit 106, a cutting processing unit 107, a label length determining unit 108, and a storage unit 110.

The control unit 101 controls various processing capable of being performed by the printing device 1. The functions of the control unit 101 are realized, for example, by a computer (processor) included in the printing device 1 executing various programs.

The adapter detection unit 102 detects the medium adapter 10 loaded in the adapter storage part 2*a*. The adapter detection unit 102 detects whether the medium adapter 10 is loaded in the adapter storage part 2*a*, for example, at the timing when the cover 4 of the printing device 1 is closed. When detecting that the medium adapter 10 is loaded, the adapter detection unit 102 detects the tape width of the recording medium 40 (thermal tape 42) stored in the loaded medium adapter 10. The adapter detection unit 102 includes, for example, plural switches arranged in the adapter storage part 2*a*. For example, the plural switches are arranged to work with plural types of medium adapters 10 in the thickness direction, where the plural types of medium adapters 10 can be loaded in the adapter storage part 2*a* so that combinations of outputs will be combinations different in the thickness of the loaded medium adapter 10.

The input unit 103 accepts input of characters and figures, input for various settings, input of instructions to execute various processes, and the like. The function of the input unit 103 is realized, for example, by the input device 3. The display unit 104 displays various kinds of information input through the input unit 103. The function of the display unit 104 is realized by the display device 5.

The feeding processing unit 105 performs feeding processing on the thermal tape 42 under the control of the control unit 101. The function of the feeding processing unit 105 is realized, for example, by a feeding mechanism including the platen roller 6 and the feeding motor.

The printing processing unit 106 performs printing processing on the thermal tape 42 under the control of the control unit 101. The function of the printing processing unit 106 is realized, for example, by a printing mechanism including the thermal head 7.

The cutting processing unit 107 performs cutting processing on the thermal tape 42 under the control of the control unit 101. The function of the cutting processing unit 107 is realized, for example, by a cutting mechanism including the cutter 8. As mentioned above, the cutting processing unit 107 in the printing device 1 of the embodiment can make both the half cut and the full cut of the thermal tape 42. Either the half cut or the full cut of the thermal tape 42 can be selected, for example, by the user through the input device 3.

The label length determining unit 108 determines whether the length of a label cut by the cutting processing unit 107 is a length more than a threshold value. The threshold value is set based on such a label length that allows for a half cut of the thermal tape 42 with print data printed thereon, and such a length that a label obtained by making a full cut can be ejected from the outlet 2*p*. When the label length determining unit 108 determines that the length of the label is less than or equal to the threshold value, the control unit 101 adjusts the length of the label based on the determination result to make the length of the label longer than the threshold value. For example, the control unit 101 changes the printing start position on the thermal tape 42 to make the length of the label longer.

The storage unit 110 stores various programs executed by the control unit 101 during the operation of the printing device 1, various kinds of information referred to by the control unit 101 during the operation of the printing device 1, and the like.

Figure 7:
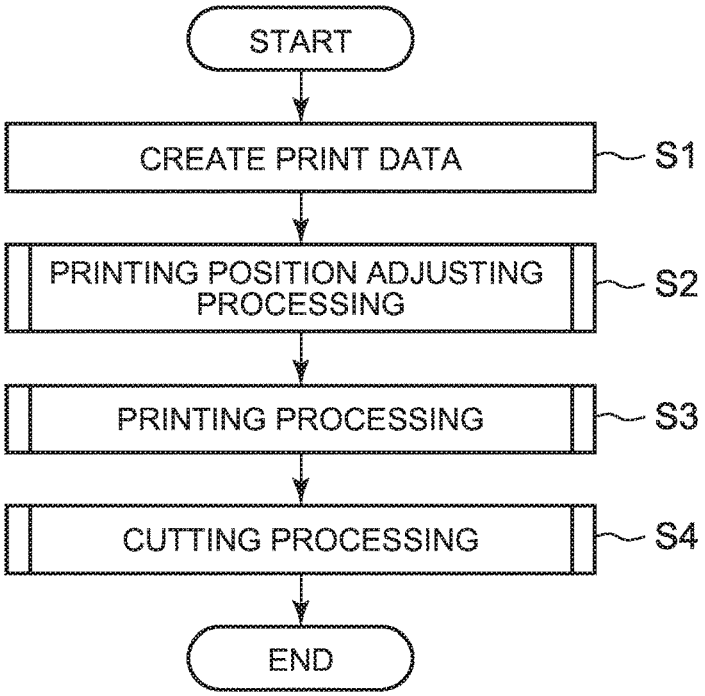
FIG. 7 is a flowchart for describing processing performed by the printing device 1 according to the embodiment.

When accepting the input of an instruction to start label creation processing through the input unit 103, the printing device 1 of the embodiment starts the label creation processing. As the label creation processing, for example, the printing device 1 of the embodiment performs processing along a flowchart of FIG. 7. FIG. 7 is a flowchart for describing processing performed by the printing device 1 according to the embodiment. Note that a process of detecting whether the medium adapter 10 is loaded or not, and a process of identifying the type of thermal tape 42 supplied from the medium adapter 10 are omitted in the flowchart of FIG. 7.

As illustrated in FIG. 7, in the printing device 1 of the embodiment, print data indicative of a content to be printed in an area cut out as a label is created (step S1). The processing of step S1 is performed by the control unit 101 in cooperation with the input unit 103 and the display unit 104. When the user of the printing device 1 enters characters or figures through the input unit 103, the control unit 101 displays the entered characters or figures on the display unit 104. Further, when the user changes font settings or the like through the input unit 103, the control unit 101 changes the display of the display unit 104 to a display based on the settings after being changed. Further, when the user enters information related to the settings of printing conditions or the like through the input unit 103, the control unit 101 displays a print image on the display unit 104. Here, the printing conditions capable of being entered by the user in the processing of step S1 include the number of prints of print data and the setting of whether a half cut and a full cut are performed. When accepting an executive instruction for label creation entered by the user while the processing of step S1 is being performed, the control unit 101 ends the processing of step S1 and starts processing for printing, on the thermal tape 42, print data created based on information on the entered characters or figures, and various settings. Note that the control unit 101 determines whether the medium adapter 10 is loaded on the printing device 1 and the thermal tape 42 is supplied from the medium adapter 10 based, for example, on the detection result of the adapter detection unit 102 before the start of the printing processing on the thermal tape 42. When the medium adapter 10 is not loaded in the adapter storage part 2*a* of the printing device 1, or when the thermal tape 42 is not supplied from the medium adapter 10 (for example, run-out of tape), the control unit 101 displays an error message on the display unit 104.

When the processing for creating a label is started, the control unit 101 first performs printing position adjusting processing (step S2) for adjusting a printing position of print data. For example, the processing of step S2 is performed by the control unit 101 in cooperation with the label length determining unit 108. In the processing of step S2, the control unit 101 first determines whether it is set to perform cutting processing on the thermal tape 42 with print data printed thereon. When it is not set to perform the cutting processing, the control unit 101 ends the processing of step S2 without adjusting the printing position and performs printing processing (step S3).

When it is set to perform the cutting processing, the control unit 101 causes the label length determining unit 108 to determine, for example, whether a length L of a label with print data printed thereon is more than a threshold value Lh. Here, the threshold value Lh is such a length that disables a half cut. The label length determining unit 108 calculates, based on the size and arrangement of characters or figures in the print data, the length L of the label when the print data are printed on the thermal tape 42, and notifies the control unit 101 of information indicating whether the calculated length L of the label is more than the threshold value Lh. When it is set to perform a half cut and the length L of the label is less than or equal to the threshold value Lh, the control unit 101 adjusts the starting position of the print data on the thermal tape 42 (printing start position) so that the length of the label will be such a length that allows for the half cut. Further, the control unit 101 causes the label length determining unit 108 to determine whether the length L of the label with the print data printed thereon is more than a threshold value L0 in a similar way. Here, the threshold value L0 is a length from a full-cut position (the position of the first blade 801) on the feeding path of the printing device 1 to the outlet 2*p*. When the length L of the label is less than or equal to the threshold value L0, the control unit 101 adjusts the printing start position of the print data on the thermal tape 42. Suppose further that plural labels are continuously printed. In this case, if the sum of the lengths of the plural labels when plural pieces of print data are printed continuously on the thermal tape 42 is less than or equal to the threshold value L0, the control unit 101 will adjust the printing start position on the thermal tape 42. When adjusting the printing start position on the thermal tape 42, the control unit 101 lengthens distance from a tip 42*a* of the thermal tape 42 to the printing start position (the size of the margin area) so that distance from the tip 42*a* of the thermal tape 42 to the full-cut position will be longer than the threshold value L0. When it is determined that the adjustment of the printing start position is unnecessary, the control unit 101 leaves the printing start position at an initial set position.

In the processing of step S2, the label length determining unit 108 may also determine whether the length L of the label with the print data printed thereon is more than either the threshold value Lh or the threshold value L0. Further, in the processing of step S2, when the length L of the label is determined to be less than or equal to the threshold value Lh, the label length determining unit 108 may also determine whether the length L of the label after a position of starting printing of the print data on the thermal tape 42 is adjusted is more than the threshold value L0.

After completion of the printing position adjusting processing, the printing device 1 performs the printing processing (step S3) for printing out print data on the thermal tape 42. The processing of step S3 is performed by the control unit 101 in cooperation with the feeding processing unit 105 and the printing processing unit 106. In the processing of step S3, the control unit 101 first causes the feeding processing unit 105 to feed the thermal tape 42 so that the printing start position on the thermal tape 42 will come out on heating elements of the thermal head 7. After that, the control unit 101 causes the feeding processing unit 105 to feed the thermal tape 42 in a predetermined direction, and causes the printing processing unit 106 to print out the print data on the thermal tape 42 in synchronization with the feeding of the thermal tape 42. After the printing processing unit 106 completes printing on the thermal tape 42, the control unit 101 causes the feeding processing unit 105 to complete the feeding of the thermal tape 42, and ends the printing processing.

After completion of the printing processing, the printing device 1 performs cutting processing (step S4) for cutting an area in which the print data are printed on the thermal tape 42. The processing of step S4 is performed by the control unit 101 in cooperation with the feeding processing unit 105 and the cutting processing unit 107. In the processing of step S4, the control unit 101 first determines whether it is set to perform the cutting processing on the thermal tape 42 with the print data printed thereon. When determining that it is not set to perform the cutting processing, the control unit 101 causes the feeding processing unit 105 to feed the thermal tape 42 instead of cutting the thermal tape 42 so that the area with the print data printed therein will be ejected from the outlet 2*p*, and ends the processing of step S4.

When it is set to perform the cutting processing, the control unit 101 first cooperates with the feeding processing unit 105 and the cutting processing unit 107 to execute a process of making a half cut of the thermal tape 42 at the printing start position. In the process of making the half cut, the control unit 101 causes the feeding processing unit 105 to feed the thermal tape 42 so that the printing start position on the thermal tape 42 will come to a position opposite to the second blade 802 of the cutter 8 on the feeding path. Further, the control unit 101 causes the cutting processing unit 107 to make the half cut at the printing start position of the thermal tape 42 using the second blade 802 of the cutter 8. Suppose here that plural labels are continuously printed in the printing processing (step S3). In this case, in the process of making the half cut, each of printing start positions in plural areas with print data printed therein is half cut, respectively.

After the process of making the half cut, the control unit 101 cooperates with the feeding processing unit 105 and the cutting processing unit 107 to execute a process of making a full cut at the full-cut position on the thermal tape 42. In the process of making the full cut, the control unit 101 causes the feeding processing unit 105 to feed the thermal tape 42 so that the full-cut position on the thermal tape 42 will come to a position opposite to the first blade 801 of the cutter 8 on the feeding path. Further, the control unit 101 causes the cutting processing unit 107 to make the full cut of the thermal tape 42 using the first blade 801 of the cutter 8.

When the full-cut position on the thermal tape 42 is full cut, the printing device 1 ends the series of processing and enters a standby state. When the printing device 1 is in the standby state, for example, if the input of an instruction to start the creation of a new label is accepted at the input unit 103, the printing device 1 performs the processing of steps S1 to S4.

Thus, in the printing device 1 of the embodiment, when created print data are printed on the thermal tape 42, the printing position adjusting processing (step S2) for adjusting the printing position of the print data is first performed. As the printing position adjusting processing, the control unit 101 and the label length determining unit 108 of the printing device 1 perform the processing, for example, along a flowchart of FIG. 8.

Figure 8:
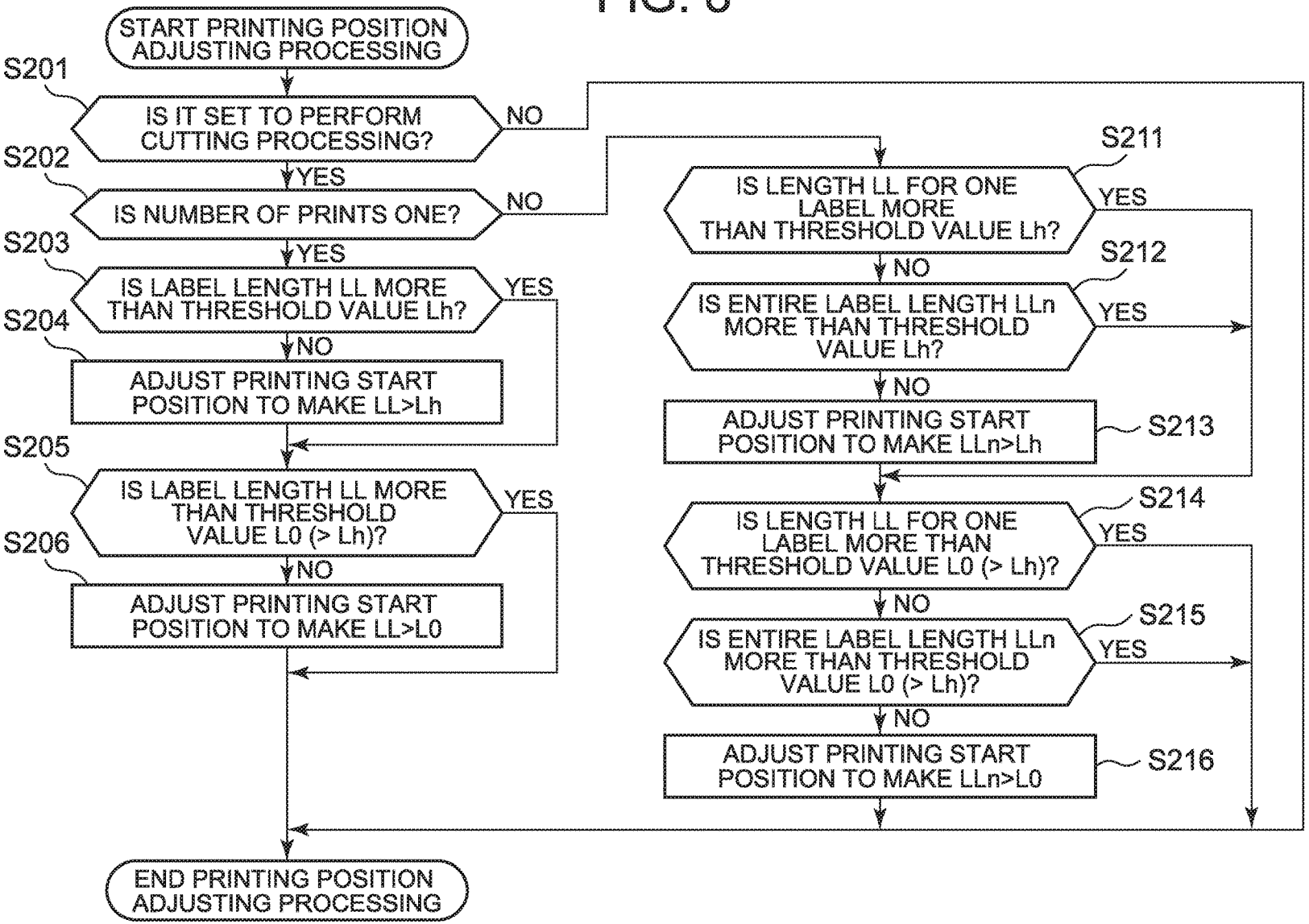
FIG. 8 is a flowchart for describing the content of printing position adjusting processing.

FIG. 8 is a flowchart for describing the content of the printing position adjusting processing.

In the printing position adjusting processing (step S2), the control unit 101 first determines whether it is set to perform cutting processing (step S201). The setting of whether to perform the cutting processing is entered by the user through the input unit 103, for example, in the processing for creating print data (step S1). When the user sets not to perform the cutting processing at the time of label creation, the printing device 1 ejects the thermal tape 42 without cutting an area with print data printed therein after the print data are printed on the thermal tape 42. Therefore, when it is not set to perform the cutting processing (NO in step S201), the control unit 101 recognizes that the adjustment of the printing position is unnecessary and ends the printing position adjusting processing.

When it is set to perform the cutting processing (YES in step S201), the control unit 101 next determines whether the number of prints of print data is one (step S202). The number of prints of print data is entered by the user through the input unit 103, for example, in the processing for creating print data (step S1).

When the number of prints is one (YES in step S202), the control unit 101 cooperates with the label length determining unit 108 to determine whether the length LL of a label is more than the threshold value Lh (step S203). In the determination process of step S203, for example, the control unit 101 first calculates the length LL of the label based on the length L of an area in which print data are printed, and a length S of the margin area. Here, the length S of the margin area is distance from the tip of the thermal tape 42 to the initial set position of the printing start position of print data. When the number of prints is one, the control unit 101 calculates, as the length LL of the label, the sum (S+L) of the length S of the margin area and the length L of the area in which the print data are printed. After that, the label length determining unit 108 compares the length LL of the label with the threshold value Lh, and notifies the control unit 101 of the comparison result. The threshold value Lh is a value set as such a length that disables a half cut in the printing device 1.

When the length LL of the label is more than the threshold value Lh (YES in step S203), the control unit 101 next cooperates with the label length determining unit 108 to determine whether the length LL of the label is more than the threshold value L0 (step S205).

On the other hand, when the length LL of the label is less than or equal to the threshold value Lh (NO in step S203), the control unit 101 next adjusts the printing start position (the length S of the margin area) to make LL>Lh (step S204). For example, when the threshold value Lh is 2 cm and the length LL of the label is 1.8 cm, the control unit 101 lengthens the length S of the margin area by more than 0.2 cm so that the length LL of the label will be longer than the threshold value Lh. In other words, the control unit 101 lengthens the distance from the tip 42*a* of the thermal tape 42 to the printing start position of print data to make the length LL of the label longer than the threshold value Lh so that a half cut can be performed in the printing device 1. When the printing start position is adjusted in step S204, the control unit 101 next cooperates with the label length determining unit 108 to determine whether the length LL of the label is more than the threshold value L0 (step S205).

In the determination process of step S205, for example, the control unit 101 first calculates the length LL of the label based on the length L of the area in which print data are printed and the length S of the margin area. Here, the length S of the margin area is distance from the tip of the thermal tape 42 to the printing start position of print data. In other words, when the process of step S204 is not executed, the length S of the margin area is distance from the tip of the thermal tape 42 to the initial set position of the printing start position of print data. On the other hand, when the process of step S204 is executed, the length S of the margin area is distance from the tip of the thermal tape 42 to the printing start position after being adjusted. When the number of prints is one, the control unit 101 calculates, as the length LL of the label, the sum (S+L) of the length S of the margin area and the length L of the area in which print data are printed. After that, the label length determining unit 108 compares the length LL of the label with the threshold value L0, and notifies the control unit 101 of the comparison result. The threshold value L0 is distance to the outlet 2*p* from a position at which a full cut is performed on the feeding path of the printing device 1.

When the length LL of the label is more than the threshold value L0 (YES in step S205), the control unit 101 recognizes that the printing start position currently set is the printing start position of print data, and ends the printing position adjusting processing.

On the other hand, when the length LL of the label is less than or equal to the threshold value L0 (NO in step S205), the control unit 101 next adjusts the printing start position (the length S of the margin area) to make LL>L0 (step S206). For example, when the threshold value L0 is 2.5 cm and the length LL of the label is 2.0 cm, the control unit 101 lengthens the length S of the margin area by more than 0.5 cm to make the length LL of the label longer than the threshold value L0. In other words, the control unit 101 lengthens the distance from the tip 42*a* of the thermal tape 42 to the printing start position of print data to make the length LL of the label longer than the threshold value L0 so that a full cut can be performed in the printing device 1. When the process of step S206 is executed, the control unit 101 recognizes, as the printing start position of print data, the printing start position after being adjusted, and ends the printing position adjusting processing.

On the contrary, when the number of prints is two or more (NO in step S202), the control unit 101 next cooperates with the label length determining unit 108 to determine whether a length LL for one label is more than the threshold value Lh (step S211). In the process of step S211, the control unit 101 first calculates the length LL for one label based on the length S of the margin area and a length L of an area in which print data for one label are printed. After that, the label length determining unit 108 compares the length LL for one label with the threshold value Lh, and notifies the control unit 101 of the comparison result.

When the label length LL is more than the threshold value Lh (YES in step S211), the control unit 101 next cooperates with the label length determining unit 108 to determine whether the length LL for one label is more than the threshold value L0 (step S214).

On the other hand, when the label length LL is less than or equal to the threshold value Lh (NO in step S211), the control unit 101 next cooperates with the label length determining unit 108 to determine an entire label length LLn is more than the threshold value Lh (step S212). In the process of step S212, for example, the control unit 101 calculates the entire label length LLn based on the length S of the margin area, the length LL of an area in which print data for one label are printed, and the number n of prints. After that, the label length determining unit 108 compares the entire label length LLn with the threshold value Lh, and notifies the control unit 101 of the comparison result.

When the entire label length LLn is more than the threshold value Lh (YES in step S212), the control unit 101 next cooperates with the label length determining unit 108 to determine whether the length LL for one label is more than the threshold value L0 (step S214). In other words, in the printing device 1 of the embodiment, a half cut is performed in the printing device 1 as long as the entire length LLn of n labels is more than the threshold value Lh even when the length LL for one label is less than or equal to the threshold value Lh.

On the other hand, when the entire label length LLn is less than or equal to the threshold value Lh (NO in step S212), the control unit 101 adjusts the printing start position (the length S of the margin area) to make LLn>Lh (step S213). For example, when the threshold value Lh is 2 cm and the entire label length LLn is 1.8 cm, the control unit 101 lengthens the length S of the margin area by more than 0.2 cm to make the entire label length LLn longer than the threshold value Lh. In other words, the control unit 101 lengthens the distance from the tip 42*a* of the thermal tape 42 to the position at which printing of print data is started to make the entire label length LLn longer than the threshold value Lh so that a half cut can be performed in the printing device 1. When the printing start position is adjusted in step S204, the control unit 101 next cooperates with the label length determining unit 108 to determine whether the length LL for one label is more than the threshold value L0 (step S214).

In the process of step S214, for example, the control unit 101 first calculates the length LL for one label based on the length L of the area in which print data are printed and the length S of the margin area. Here, the length S of the margin area is the distance from the tip of the thermal tape 42 to the printing start position of print data. In other words, when the process of step S213 is not executed, the length S of the margin area is the distance from the tip of the thermal tape 42 to the initial set position of the printing start position of print data. On the other hand, when the process of step S213 is executed, the length S of the margin area is the distance from the tip of the thermal tape 42 to the printing start position after being adjusted. The control unit 101 calculates, as the length LL for one label, the sum (S+L) of the length S of the margin area and the length L of the area in which print data for one label are printed. After that, the label length determining unit 108 compares the label length LL with the threshold value L0, and notifies the control unit 101 of the comparison result.

When the length LL for one label is more than the threshold value L0 (YES in step S214), the control unit 101 recognizes that the printing start position currently set is the printing start position of print data, and ends the printing position adjusting processing.

On the other hand, when the length LL for one label is less than or equal to the threshold value L0 (NO in step S214), the control unit 101 next cooperates with the label length determining unit 108 to determine whether the entire label length LLn is more than the threshold value L0 (step S215). In the determination process of step S215, for example, the control unit 101 calculates the entire label length LLn based on the length S of the margin area, the length LL of the area in which print data for one label are printed, and the number n of prints. After that, the label length determining unit 108 compares the entire label length LLn with the threshold value L0, and notifies the control unit 101 of the comparison result.

When the entire label length LLn is more than the threshold value L0 (YES in step S215), the control unit 101 recognizes that the printing start position currently set is the printing start position of print data, and ends the printing position adjusting processing. In other words, in the printing device 1 of the embodiment, a full cut is performed in the printing device 1 as long as the entire length LLn of n labels to be printed continuously is more than the threshold value Lh even when the length LL for one label is less than or equal to the threshold value L0.

On the other hand, when the entire label length LLn is less than or equal to the threshold value L0 (NO in step S215), the control unit 101 adjusts the printing start position (the length S of the margin area) to make LLn>L0 (step S216). For example, when the threshold value L0 is 2 cm and the entire label length LLn is 1.8 cm, the control unit 101 lengthens the length S of the margin area by more than 0.2 cm to make the entire label length LLn longer than the threshold value Lh. In other words, the control unit 101 lengthens the distance from the tip 42*a* of the thermal tape 42 to the printing start position of print data to make the entire label length LLn longer than the threshold value L0 so that a full cut can be performed in the printing device 1. When the printing start position is adjusted in step S216, the control unit 101 recognizes that the printing start position currently set is the printing start position of print data, and ends the printing position adjusting processing.

After completion of the printing position adjusting processing, the printing device 1 performs the printing processing (step S3). As the printing processing, the printing device 1 of the embodiment performs processing, for example, along a flowchart of FIG. 9.

Figure 9:
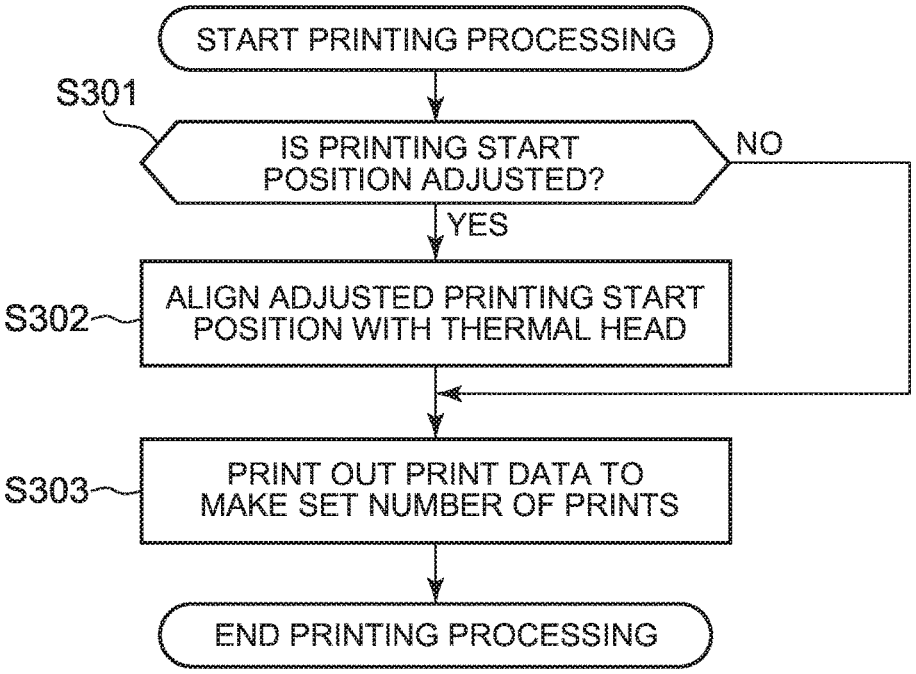
FIG. 9 is a flowchart for describing the content of the printing processing.

FIG. 9 is a flowchart for describing the content of the printing processing.

As mentioned above, the printing processing is performed by the control unit 101 of the printing device 1 in cooperation with the feeding processing unit 105 and the printing processing unit 106. The control unit 101 first determines whether the printing start position is adjusted in the printing position adjusting processing (step S301). When the printing start position is adjusted (YES in step S301), the control unit 101 causes the feeding processing unit 105 to align the adjusted printing start position with the thermal head (step S302). In step S302, the control unit 101 causes the feeding processing unit 105 to execute a process of feeding the thermal tape 42 by a distance between the initial set position of the printing start position on the thermal tape 42 and the printing start position after being adjusted. After completion of the process of step S302, the control unit 101 cooperates with the feeding processing unit 105 and the printing processing unit 106 to print out print data to make a set number of prints (step S303). Further, when the printing position is not adjusted in the printing position adjusting processing (NO in step S301), the control unit 101 omits the process of step S302 and executes the process of step S303.

In the process of step S303, the control unit 101 causes the feeding processing unit 105 to execute a process of feeding the thermal tape 42 in a predetermined feeding direction at a predetermined feeding speed, and causes the printing processing unit 106 to print out print data on the thermal tape 42 in synchronization with feeding of the thermal tape 42. The control unit 101 causes the printing processing unit 106 to execute processes of dividing the area, in which print data are printed on the thermal tape 42, into micro regions each corresponding to every heating element, and applying heat energy to those of the micro regions, which are made to develop color at timing when the micro regions pass over the heating elements of the thermal head 7. After the print data are printed for a set number of prints, the control unit 101 ends the printing processing.

After completion of the printing processing, the printing device 1 performs cutting processing for cutting the thermal tape 42 with print data printed thereon (step S4). As the cutting processing, the printing device 1 of the embodiment performs processing, for example, along a flowchart of FIG. 10.

Figure 10:
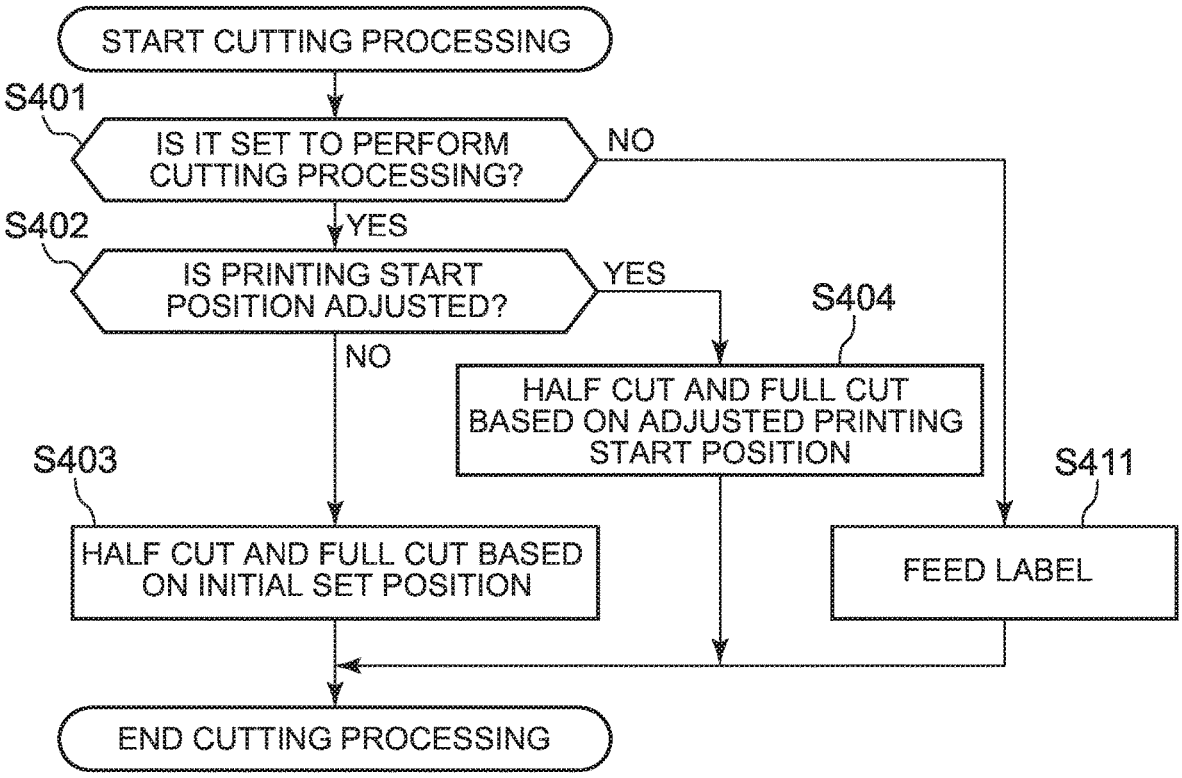
FIG. 10 is a flowchart for describing the content of the cutting processing.

FIG. 10 is a flowchart for describing the content of the cutting processing.

In the cutting processing (step S4), the control unit 101 first determines whether it is set to perform the cutting processing (step S401). The setting of whether to perform the cutting processing is entered by the user through the input unit 103, for example, in the processing for creating print data (step S1). When the user sets not to perform the cutting processing at the time of label creation, the printing device 1 ejects the thermal tape 42 without cutting an area with print data printed therein after the print data are printed on the thermal tape 42. Therefore, when it is not set to perform the cutting processing (NO in step S401), the control unit 101 causes the feeding processing unit 105 to feed the label (step S411), and ends the printing position adjusting processing. In step S411, the feeding processing unit 105 feeds the thermal tape 42 so that the entire area in which print data are printed on the thermal tape 42 will be ejected to the outside of the printing device 1 through the outlet 2*p* of the printing device 1. In this case, the user cuts with scissors the area with print data printed on the thermal tape 42 ejected from the printing device 1 to obtain a label.

On the other hand, when it is set to perform the cutting processing (YES in step S401), the control unit 101 next determines whether the printing start position is adjusted in the printing position adjusting processing (step S402).

When the printing start position is not adjusted (NO in step S402), the control unit 101 cooperates with the feeding processing unit 105 and the cutting processing unit 107 to perform a half cut and a full cut based on the initial set position of the printing start position (step S403). In the process of step S403, the control unit 101 first causes the feeding processing unit 105 to feed the thermal tape 42 so that the printing start position on the thermal tape 42 will face the second blade 802 of the cutter 8, and then causes the cutting processing unit 107 to perform a half cut using the second blade 802. Further, when the number of prints is two or more, the control unit 101 causes the feeding processing unit 105 and the cutting processing unit 107 to execute a process of making a half cut of each of printing start positions of plural areas with print data printed therein, respectively. After completion of the process of making the half cut, the control unit 101 causes the feeding processing unit 105 to feed the thermal tape 42 so that the full-cut position on the thermal tape 42 will face the first blade 801 of the cutter 8, and causes the cutting processing unit 107 to make a full cut using the first blade 801.

On the other hand, when the printing start position is adjusted (YES in step S402), the control unit 101 cooperates with the feeding processing unit 105 and the cutting processing unit 107 to perform the half cut and the full cut based on the printing start position after being adjusted (step S404). In the process of step S404, the content of the process is the same as the process of step S403 except that the half-cut position (the printing start position) and the full-cut position on the thermal tape 42 become positions after being adjusted in the printing position adjusting processing, respectively.

After completion of the process of step S403 or S404, the control unit 101 ends the cutting processing. When the cutting processing is ended, the printing device 1 ends the processing for creating a label based on print data created in step S1.

Thus, suppose that it is set to perform the cutting processing in the printing device 1 of the embodiment. In this case, when the length LL for one label is less than or equal to the threshold value Lh, the length S of the margin area is adjusted to make LL>Lh in order to adjust the printing start position. As mentioned above, the threshold value Lh is such a length that disables a half cut in the printing device 1. For example, when the label length LL is less than or equal to the threshold value Lh, no half cut is performed to prevent a tape jam in the conventional printing device even if it is set to perform a half cut. On the other hand, in the printing device 1 of the embodiment, when the number of prints is one and the length LL for one label calculated based on the initial position of the printing start position is less than or equal to the threshold value Lh, since the printing start position is adjusted to make LL>Lh, it is possible to perform a half cut. Further, when the length LL for one label is less than or equal to the threshold value L0 in the case where it is set to perform the cutting processing in the printing device 1 of the embodiment, the length S of the margin area is adjusted to make LL>L0 to adjust the printing start position. As mentioned above, the threshold value L0 is the distance from the full-cut position to the outlet, from which the tape is ejected, in the printing device 1. For example, when the label length LL is less than or equal to the threshold value L0, no full cut is performed to prevent a tape jam even if it is set to perform a full cut in the conventional printing device. On the other hand, in the printing device 1 of the embodiment, when the number of prints is one and the length LL for one label calculated based on the initial position of the printing start position is less than or equal to the threshold value L0, since the printing start position is adjusted to make LL>L0, it is possible to perform a full cut.

Further, in the printing device 1 of the embodiment, a half cut is performed when the entire length LLn of plural labels created all at once as one piece by continuous printing is more than the threshold value Lh. In addition, in the printing device 1 of the embodiment, a full cut is performed when the entire length LLn of the plural labels created all at once as one piece by continuous printing is more than the threshold value L0. Furthermore, when the entire label length LLn is less than or equal to the threshold value Lh or the entire label length LLn is less than or equal to the threshold value L0, the printing device 1 adjusts the length S of the margin area to make LLn>Lh or LLn>L0 in order to adjust the printing start position. In other words, in the printing device 1 of the embodiment, a tape jam caused by performing a half cut can be prevented even if the length LL for one label is less than or equal to the threshold value Lh when the plural labels are created all at once by continuous printing. Similarly, in the printing device 1 of the embodiment, a tape jam caused by performing a full cut can be prevented even if the length LL for one label is less than or equal to the threshold value L0 when the plural labels are created all at once by continuous printing.

Figure 11:
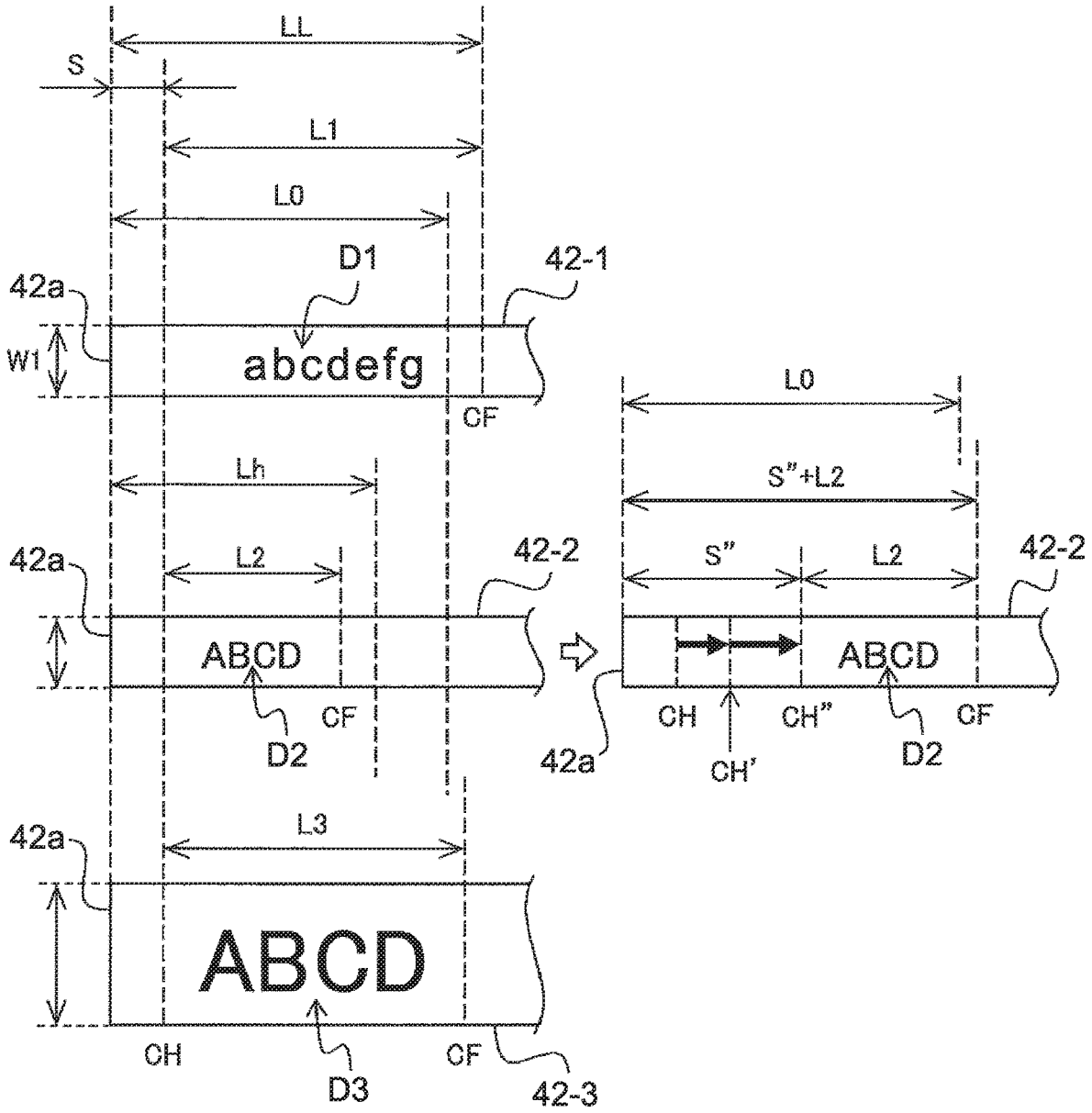
FIG. 11 is a diagram for describing label creation processing when the number of prints is one.

FIG. 11 is a diagram for describing the label creation processing when the number of prints is one. In FIG. 11, an example of label creation processing is illustrated, where print data are printed on a first thermal tape 42-1 having a tape width W1, on a second thermal tape 42-2 having the tape width W1, and on a third thermal tape 42-3 having a tape width W2 (>W1), respectively. The initial set position CH of each of the printing start positions of the first thermal tape 42-1, the second thermal tape 42-2, and the third thermal tape 42-3 is set to a position apart a distance S from the tip 42*a* (the left end in FIG. 11) of each thermal tape.

On the first thermal tape 42-1, print data D1 indicative of a character string "abcdefg" are printed. When one label with print data D1 printed thereon is created in the printing device 1, the user can select whether the printing start position is half cut or a label including an area with print data D1 printed therein is full cut at a full-cut position CF. The full-cut position CF is a position (i.e., the printing end position) as an end opposite to the printing start position of both ends of the area in which print data D1 are printed in the longitudinal direction of the first thermal tape 42-1.

When it is set to half cut the printing start position, the printing device 1 determines whether the label length LL is more than the threshold value Lh in the printing position adjusting processing (step S2) (step S203 in FIG. 8). The label length LL on the first thermal tape 42-1 in FIG. 11 is the sum (S+L1) of the length S of the margin area set in a tip portion of the first thermal tape 42-1 and a length L1 of the area in which print data D1 are printed. The label length LL (=S+L1) on the first thermal tape 42-1 of FIG. 11 is longer than the threshold value Lh. Therefore, the printing device 1 omits the process of step S204 in FIG. 8, and next determines whether the label length LL is more than the threshold value L0 (step S205 in FIG. 8). The label length LL (=S+L1) on the first thermal tape 42-1 of FIG. 11 is longer than the threshold value L0. Therefore, when print data D1 are printed on the first thermal tape 42-1 to create one label, the printing device 1 prints out print data D1 by setting the initial set position CH of the printing start position as the printing start position.

After the print data D1 are printed, the printing device 1 half cuts the first thermal tape 42-1 at the initial set position CH of the printing start position. Further, when it is set to make a full cut, the printing device 1 full cuts the first thermal tape 42-1 at the full-cut position CF. The label length LL obtained by making the full cut of the first thermal tape 42-1 is longer than the threshold value L0 (i.e., distance to the outlet 2*p* from a position at which the first thermal tape 42-1 is full cut on the feeding path of the printing device 1). Therefore, when print data D1 are printed out on the first thermal tape 42-1 to create a label, the tip portion of the label projects from the outlet 2*p* to the outside of the printing device 1 even when the printing start position remains at the initial set position CH. Thus, the user can pull out the created label from the printing device 1 after the cutting processing.

Further, print data D3 indicative of a character string "ABCD" are printed out on the third thermal tape 42-3 of FIG. 11. The number of characters included in print data D3 is smaller than the number of characters included in print data D1. However, as illustrated in FIG. 11, the size of each character printed on the third thermal tape 42-3 is larger than the size of each character printed on the first thermal tape 42-1. Therefore, when print data D3 are printed on the third thermal tape 42-3 to create a label, the label length LL (i.e., the sum of the length S of the margin area and a length L3 of an area in which print data D3 are printed) may be longer than the threshold value L0 as illustrated in FIG. 11. In such a case, in the printing device 1 of the embodiment, print data D3 are printed by setting, as the printing start position, the initial set position CH of the printing start position on the third thermal tape 42-3. Then, when it is set to make a half cut, the printing device 1 half cuts the third thermal tape 42-3 at the initial set position CH of the printing start position. Further, when it is set to make a full cut, the printing device 1 full cuts the third thermal tape 42-3 at the full-cut position CF. The label length LL (=S+L3) obtained by the full cut of the third thermal tape 42-3 is longer than the threshold value L0. Therefore, when print data D3 are printed on the third thermal tape 42-3 to create a label, the tip portion of the label projects from the outlet 2*p* to the outside of the printing device 1 even when the printing start position remains at the initial set position CH. Thus, the user can pull out the created label from the printing device 1 after the cutting processing.

On the other hand, the font size of print data D2 indicative of a character string "ABCD" printed on the second thermal tape 42-2 is smaller than the font size of print data D3 printed on the third thermal tape 42-3. Therefore, as illustrated in FIG. 11, the length L2 of an area in which print data D2 are printed on the second thermal tape 42-2 is shorter than the length L3 of an area in which print data D3 are printed on the third thermal tape 42-3. Further, in the example illustrated in FIG. 11, the label length LL (=S+L2) when print data D2 are printed by setting, as the printing start position, the initial set position CH of the printing start position is less than or equal to the threshold value Lh. Therefore, if print data D2 are printed by setting, as the printing start position, the initial set position CH of the printing start position, and then the half cut and the full cut are performed, the cut thermal tape (label) will be retained on the feeding path to cause a tape jam. However, in the printing device 1 of the embodiment, when the label length LL (=S+L2) is less than or equal to the threshold value Lh in the case where print data D2 are printed by setting, as the printing start position, the initial set position CH of the printing start position, the length S of the margin area in the tip portion of the second thermal tape 42-2 is adjusted to make LL>Lh (step S204 in FIG. 8). When the process of step S204 is executed, the printing start position of print data D2 on the second thermal tape 42-2 is changed from the initial set position CH to CH' as illustrated in the second thermal tape 42-2 on the right side of FIG. 11.

As mentioned above, in the process of step S204, the printing start position is so adjusted that the label length LL (=S+L2) will be more than the threshold value Lh. Therefore, the label length LL calculated based on the printing start position CH' determined in step S204 may be less than or equal to the threshold value L0. In the case of LL≤L0, if the second thermal tape 42-2 is full cut at the full-cut position CF, the cut thermal tape (label) will be retained on the feeding path to cause a tape jam. Therefore, in the printing device 1 of the embodiment, when the label length LL is less than or equal to the threshold value L0, the length of the margin area in the tip portion of the second thermal tape 42-2 is adjusted to make LL>L0 (step S206 in FIG. 8). In the process of step S206, the printing device 1 sets a position CH", at which the length of the margin area is S", as a new printing start position as illustrated in FIG. 11. Thus, the label length LL (=S"+L2) created by printing out print data D2 on the second thermal tape 42-2 becomes longer than the threshold value L0. Therefore, even if the second thermal tape 42-2 with print data D2 printed thereon is half cut or full cut, the tape jam or the like caused by the fact that the thermal tape (label) is retained on the feeding path can be prevented. Thus, according to the printing device 1 of the embodiment, such a function as to omit the cutting processing (half cut and full cut) in the printing device 1 when the length of the printing area on the print tape is insufficient can be removed. This can lead, for example, to prevention of the occurrence of such a situation that a piece of label is ejected without being cut despite the fact that the label is created in such a setting as to perform a half cut and a full cut so that the user will have to cut the label with scissors or the like.

Further, in the printing device 1 of the embodiment, the label length LL created in such a setting as to make a full cut becomes longer than the threshold value L0 regardless of the length of the area in which print data are printed. Therefore, even when a label is created by printing out print data D2 on the second thermal tape 42-2 in FIG. 11, the label is large compared with a label (a label having the length S+L2) cut by the user with scissors or the like, and hence it is easy to see the label. Therefore, according to the printing device 1 of the embodiment, it is less likely to lose the created label.

Figure 12:
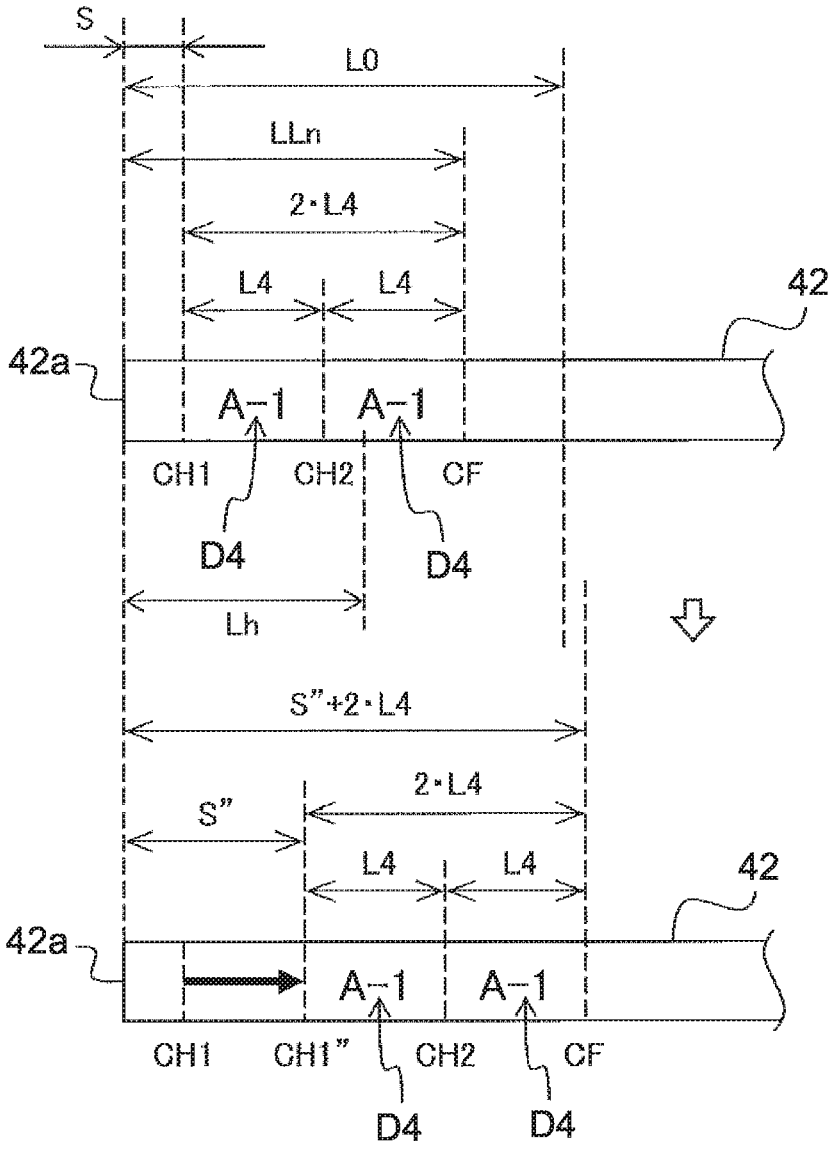
FIG. 12 is a diagram for describing the label creation processing when the number of prints is two.

FIG. 12 is a diagram for describing the label creation processing when the number of prints is two. In FIG. 12, an example in which two labels of print data D4 indicative of a character string "A-1" are printed on a thermal tape 42 is illustrated. On an upper thermal tape 42 of two thermal tapes 42 lined up and down in FIG. 12, an area in which print data D4 are printed when print data D4 are printed by setting an initial set position CH1 as the printing start position is illustrated. An area in which print data D4 are printed in the first round of printing with the initial set position CH1 set as the printing start position is an area as a first label. Assuming here that the printing area of print data D4 is a length L4, a printing start position CH2 of an area in which print data D4 are printed in the second round of printing (that is, an area as a second label) comes to a position distance L4 apart from the initial set position CH1. Further, the full-cut position CF comes to a position distance L4 further apart from the printing start position CH2.

Suppose that two labels of print data D4 are continuously printed in this way. In a conventional printing device, for example, if the length LL for one label (the sum of the length S of the margin area and the length L4 of the area in which one label of print data D4 is printed) is less than or equal to the threshold value Lh, a half cut may not be made even though it is set to make the half cut. Further, for example, in the conventional printing device, if the length LL for one label is less than or equal to the threshold value L0, a full cut may not be made even though it is set to make the full cut. Therefore, when plural labels are created all at once, a piece of label with individual labels inseparate from one another is ejected from the conventional printing device, and hence the user has to do the work to cut and divide the piece of label for plural labels into individual labels with scissors or a cutter.

In contrast, in the printing device 1 of the embodiment, even when the length LL for one label (the sum of the length S of the margin area and the length L4 of the area in which print data D4 for one label are printed) is less than or equal to the threshold value Lh, a half cut is performed as long as the entire label length LLn is more than the threshold value Lh. Therefore, when print data D4 are printed to create two labels in such a setting as to set initial set position CH1 as the printing start position like the thermal tape 42 illustrated on the upper side of FIG. 12, if it is set to make a half cut, the printing device 1 will make half cuts at the printing start positions CH1 and CH2.

When print data D4 are printed to create two labels in such a setting as to set initial set position CH1 as the printing start position like the thermal tape 42 illustrated on the upper side of FIG. 12, the printing device 1 first determines, in the printing position adjusting processing (step S2), whether the length LL for one label is more than the threshold value Lh (step S211). Since the length LL for one label (=S+L4) on the thermal tape 42 illustrated on the upper side of FIG. 12 is less than or equal to the threshold value Lh, the printing device 1 next determines whether the entire label length LLn (=S+2·L4) is more than the threshold value Lh (step S212). Since the entire label length LLn on the thermal tape 42 illustrated on the upper side of FIG. 12 is more than the threshold value Lh, the printing device 1 omits step S213 of adjusting the printing start position, and next determines whether the length LL for one label is more than the threshold value L0 (step S214). Since the length LL for one label (=S+L4) on the thermal tape 42 illustrated on the upper side of FIG. 12 is less than or equal to the threshold value L0, the printing device 1 next determines whether the entire label length LLn (=S+2·L4) is more than the threshold value L0 (step S215). Since the entire label length LLn on the thermal tape 42 illustrated on the upper side of FIG. 12 is less than or equal to the threshold value L0, the printing device 1 next adjusts the printing start position to make LLn>L0 (step S216). In the process of step S216, the printing device 1 changes the length of the margin area in the tip portion from S to S" to make the entire label length LL longer than the threshold value L0 like the thermal tape 42 illustrated on the lower side of FIG. 12. In other words, in the process of step S216, the printing device 1 changes the printing start position from the initial set position CH1 to a position CH1" distance S" apart from the tip 42*a* of the thermal tape 42.

Thus, suppose that plural labels are created all at once in the printing device 1 of the embodiment. In this case, regardless of the length LL for one label, a half cut is performed when the entire label length LLn is more than the threshold value Lh, and a full cut is performed when the entire label length LLn is more than the threshold value L0. Therefore, when it is set to make a half cut and a full cut to create plural labels all at once, such a situation that a piece of label without being cut is ejected from the printing device 1 can be prevented. This can lead to prevention of the occurrence of such a situation that the user has to do cutting work using scissors or the like.

Note that the above-described embodiment is a specific example to facilitate the understanding of the invention, and the present invention is not limited to the embodiment. Various modifications and changes can be made to the printing device 1 without departing from the scope of claims.

For example, the flowchart of FIG. 8 is just an example of the printing position adjusting processing performed by the printing device 1 of the embodiment. The printing position adjusting processing performed by the printing device 1 of the embodiment can be changed appropriately without departing from the scope of the embodiment. For example, in the printing position adjusting processing performed by the printing device 1, the processes of steps S203 and S204, and the processes of steps S211 to S213 in the flowchart of FIG. 8 may be omitted. Further, for example, in the printing position adjusting processing performed by the printing device 1, the processes of steps S205 and S206, and the processes of step S214 to S216 in the flowchart of FIG. 8 may be omitted. Further, in the printing position adjusting processing performed by the printing device 1, the contents of processing may be changed between a case where it is set to make a half cut and a full cut, and a case where it is set to make only a full cut.

Further, when the printing start position (the length of the margin area) is adjusted, it is only necessary to make an adjustment so that the distance from the tip of the print tape to the full-cut position will be longer than the distance from a cutter for full cut to the outlet on the feeding path. Therefore, the distance from the initial set position of the printing start position to the full-cut position on the print tape can be shorter than the distance from the cutter for full cut to the outlet on the feeding path.

Further, when plural labels are continuously printed in the printing device 1 of the embodiment, plural pieces of print data different in content can be printed in a predetermined order such as serial number printing as well as the case where one piece of print data is repeatedly printed. Suppose that plural pieces of print data different in content are printed in a predetermined order. In this case, for example, in step S211 of the flowchart of FIG. 8, the sum of the length of an area, in which a first piece of print data is printed, among the lengths of printing areas of the plural pieces of print data, and the length S of the margin area is set as the length LL for one label.

Further, the determinations in steps S212 and S215 when the plural labels are continuously printed in the printing device 1 of the embodiment are not limited to those on the entire label length LLn. For example, the determinations may be made based on the sum of the lengths for 2 to N−1 labels.

Further, the method of supplying the print tape in the printing device 1 is not limited to the method described in the above-described embodiment, and the method can be changed appropriately. The print tape may also be supplied, for example, from a disposable tape cartridge unexpected for the user to take in and out the recording medium 40.

Further, for example, in the above-described embodiment, the printing device 1 having the input device 3 and the display device 5 is exemplified, but there is no need for the printing device 1 to have the input device and the display device. In other words, print data such as characters, figures, and the like may be input from any electronic device, such as a computer, other than the printing device 1.

Further, a program executed by a computer of the printing device 1 may include any other processing in addition to processing steps S1 to S4 in the flowchart of FIG. 7. Further, the processing of step S2 in the program executed by the computer of the printing device 1 is not limited to the processing along the flowchart of FIG. 8, and the processing can be changed appropriately. Further, the processing of step S3 in the program executed by the computer of the printing device 1 can be changed appropriately. Further, the process steps executed by the computer of the printing device 1 are not limited to the processes along the flowchart of FIG. 9, and the process steps can be changed appropriately. In addition, the processing of step S4 in the program executed by the computer of the printing device 1 is not limited to the processing along the flowchart of FIG. 10, and the processing can be changed appropriately.

What is claimed is:

1. A printing device comprising:

a printing unit which prints print data on a print medium;

a cutting unit which cuts the print medium with the print data printed thereon; and a processor, wherein:

the processor determines whether a total length of a plurality of labels to be continuously printed by the printing unit and separated from each other by the cutting unit is more than a threshold value, when it is determined that the total length is less than or equal to the threshold value, the processor adjusts the total length of the plurality of labels so that the total length will be greater than the threshold value, the cutting unit is configured to selectively perform a full cut that fully cuts through the print medium and a half cut which only partly cuts through the print medium, and the threshold value is a preset length that is based on a position at which the half cut is performed by the cutting unit.

2. The printing device according to claim 1, wherein when it is determined that the total length is less than or equal to the threshold value, the processor adjusts a length of a margin area from a tip of the print medium up to a printing area in which the print data are printed so that the total length of the plurality of labels will be greater than the threshold value.

3. The printing device according to claim 1, further comprising:

a feeding unit which feeds the print medium, wherein when it is determined that the total length is less than or equal to the threshold value, the processor adjusts a length of feeding the print medium by the feeding unit so that the total length of the plurality of labels will be greater than the threshold value.

4. The printing device according to claim 1, wherein:

the processor further determines whether the total length of the plurality of labels to be continuously printed by the printing unit and separated from each other by the cutting unit is more than a second threshold value, which is a distance to an outlet, from which the print medium is to be ejected, from a position at which the cutting unit performs the full cut which fully cuts through the print medium, and when it is determined that the total length is less than or equal to the second threshold value, the processor adjusts the total length of the plurality of labels so that the total length will be greater than the second threshold value.

5. The printing device according to claim 1, wherein the threshold value based on both the position at which the half cut is performed by the cutting unit and a position at which the full cut is performed by the cutting unit.

6. The printing device according to claim 1, wherein the processor controls the cutting unit to separate the plurality of labels from each other by performing half cuts between adjacent labels of the plurality of labels.

7. A control method executed by a printing device including a processor, the control method comprising:

determining whether a total length of a plurality of labels to be continuously printed on a print medium and separated from each other by cutting is more than a threshold value; and when it is determined that the total length is less than or equal to the threshold value, adjusting the total length of the plurality of labels so that the total length will be greater than the threshold value, wherein:

the printing device configured to selectively perform a full cut that fully cuts through the print medium and a half cut which only partly cuts through the print medium, and the threshold value is a preset length that is based on a position at which the half cut is performed by the printing device.

8. The control method according to claim 7, wherein the plurality of labels are separated from each other performing the half cut between adjacent labels of the plurality of labels.

9. A non-transitory recording medium recording thereon a computer-readable program executed by a printing device including a processor, the program causing the processor to execute processes including:

determining whether a total length of a plurality of labels to be continuously printed on a print medium and separated from each other by cutting is more than a threshold value; and when it is determined that the total length is less than or equal to the threshold value, adjusting the total length of the plurality of labels so that the total length will be greater than the threshold value, wherein:

the printing device configured to selectively perform a full cut that fully cuts through the print medium and a half cut which only partly cuts through the print medium, and the threshold value is a preset length that is based on a position at which the half cut is performed by the printing device.

10. The non-transitory computer readable medium according to claim 9, wherein the plurality of labels are separated from each other performing the half cut between adjacent labels of the plurality of labels.

* * * * *